US005529043A

United States Patent [19]

Nagaishi et al.

[11] Patent Number: 5,529,043

[45] Date of Patent: Jun. 25, 1996

[54] SIGNAL PROCESSOR

[75] Inventors: Hatsuo Nagaishi, Yokohama; Kenji Ohta; Hiroyuki Itoyama, both of Yokosuka, all of Japan

[73] Assignee: Nissan Motor Co., Ltd., Yokohama, Japan

[21] Appl. No.: 275,359

[22] Filed: Jul. 15, 1994

[30] Foreign Application Priority Data

Jul. 23, 1993 [JP] Japan ..... 5-182769

[51] Int. Cl.[6] ..... F02M 51/00

[52] U.S. Cl. ..... 123/478

[58] Field of Search ..... 123/478, 479, 123/480; 73/117.3; 364/431.05

[56] References Cited

U.S. PATENT DOCUMENTS

| | | | |
|---|---|---|---|
| 5,201,296 | 4/1993 | Wunning et al. | 123/479 |
| 5,226,393 | 7/1993 | Nagano et al. | 123/478 |
| 5,230,318 | 7/1993 | Iwamoto | 123/480 |
| 5,263,455 | 11/1993 | Iwai et al. | 123/480 |
| 5,278,762 | 1/1994 | Kawamura | 364/431.05 |
| 5,284,117 | 2/1994 | Akase | 123/445 |
| 5,363,832 | 11/1994 | Suzumura et al. | 123/478 |
| 5,404,856 | 4/1995 | Servati | 123/478 |
| 5,423,208 | 6/1995 | Dudek et al. | 73/117.3 |
| 5,427,069 | 6/1995 | Tomisawa et al. | 123/478 |

FOREIGN PATENT DOCUMENTS

| | | | |
|---|---|---|---|
| 3-222849 | 10/1991 | Japan | 123/478 |

*Primary Examiner*—Raymond A. Nelli
*Attorney, Agent, or Firm*—Foley & Lardner

[57] ABSTRACT

This invention relates to a signal processor for processing a signal and outputting a processed value. The processor comprises a mechanism for determining whether or not the signal exceeds a preset value, a mechanism for outputting the signal as the processed value when the signal does not exceed the preset value, and a mechanism for outputting the preset value as the processed value when the signal exceeds the preset value. This invention further provides a mechanism for computing a difference between the signal and the preset value when the signal exceeds the preset value, a memory for storing this difference as a postponed correction amount, and a mechanism for adding the postponed correction amount to said signal when the signal no longer exceeds the preset value. In this way, by compensating at a later time for errors arising from modifications made when the signal exceeded said preset value, the precision of operations and controls based on the processed value is improved. Further, in control systems using the integral of said signal, the precision of integral values is also improved. This invention therefore provides effective correction of signal processing errors when applied to the output of an air flow meter having a heating element wound on a bobbin, or to the control of a flowrate control valve installed in an intake air passage of a lean burn engine.

9 Claims, 26 Drawing Sheets

*Ddmll* : Air-fuel ratio variation rate towards rich

*Ddmlr* : Air-fuel ratio variation rate towards lean

SIGNAL PROCESSOR

FIELD OF THE INVENTION

This invention relates to a signal processor used for controlling an engine or the like.

BACKGROUND OF THE INVENTION

To control the fuel supply to an engine, a fuel controller is disclosed for example Tokkai Hei 3-222849 published by the Japanese Patent Office wherein an air flow meter is installed upstream of an intake air throttle, and a fuel quantity is calculated based on an intake air flowrate measured by the air flow meter.

This controller comprises a control unit consisting of a microprocessor, the output of the air flow meter (voltage) being converted to a digital value which is then input to the control unit.

However, as there is a slight response delay from the real change of air flowrate at the air flow meter to this input signal, signal processing is performed in the control unit to compensate for this response delay.

Moreover, as there is an overshoot in the computed flowrate Qs due to the pressure change in the air intake pipe during rapid acceleration, a basic fuel injection pulse width Avtp corresponding to the cylinder intake air volume is calculated in the control unit by means of the following equation, and this calculated value is output to a fuel injection valve installed in the intake port of the engine:

$$Tp=(Qs/N)*K$$

$$Avtp=Tp*Fload+Avtp_{n-1}*(1-Fload)$$

where:

N=engine speed

K=constant

Fload=air intake pipe delay coefficient $Avtp_{n-1}$=Avtp on Immediately preceding occasion However, in engines with less than six cylinders, if there is a very large air pulsation when the air intake throttle is fully open, the computed result for the intake air volume may be a negative value due to backflow of air accompanying the pulsation. Further, the computed result may be extremely large during rapid acceleration.

The flowrate applied in actual fuel control is therefore limited to within a predetermined range, for example from 0 to an upper limit of a preset range. This is due to the fact that the required precision in air-fuel ratio control was conventionally not so high, and to the fact that the amount of data increased too much when the preset range was widened.

However, if the above calculation is performed using an upper limit or lower limit for the air intake volume, the effect of the difference or error between the real value and the value of the upper or lower limit on the calculation of fuel injection amount does not terminate after one injection. In other words, as the calculation of fuel amount takes the value on the immediately preceding occasion into account, the error is perpetuated over a long time period as it gradually decreases.

FIG. 34 is a graphical representation of the change of intake air volume, Avtpr and air-fuel ratio during rapid acceleration. If the above difference or error is clipped as described hereintofore, the air-fuel ratio at the start of acceleration shifts to lean as shown by the dotted line in the figure. On the other hand, in the latter half of the graph where the intake air volume becomes a negative value due to pulsation, the negative part is clipped, so the air-fuel ratio tends to rich.

This clipping applies not only to the intake air volume measured by the air flow meter, but also to the opening signal supplied to the air intake throttle or a flow control valve in a supplementary air passage, or to the calculation of fuel injection amount. At the present time, severe requirements are imposed on the composition of exhaust gas, and the effect of this clipping on the air-fuel ratio therefore cannot be ignored.

SUMMARY OF THE INVENTION

It is therefore an object of the invention to improve control precision of a signal processor by separately storing a clipped portion of data so that it may be added to the calculation on the next and subsequent occasions.

It is a further object of the invention to increase the measurement precision of an air flow meter which measures the intake air volume of an engine.

It is still a further object of the invention to prevent rapid change of torque when the air-fuel ratio is changed over in an air-fuel ratio controller of a lean burn engine.

In order to achieve the above object, this invention provides a signal processor for processing a signal and outputting a processed value, comprising a mechanism for determining whether or not the signal exceeds a preset value, a mechanism for outputting the signal as the processed value when the signal does not exceed the preset value, and a mechanism for outputting the preset value as the processed value when the signal exceeds the preset value. The signal processor further comprises a mechanism for computing a difference between the signal and the preset value when the signal exceeds the preset value, a mechanism for storing the difference as a postponed correction amount, a mechanism for adding the postponed correction amount to the signal when the signal no longer exceeds the preset value, and a mechanism for outputting the added amount as the processed value.

Preferably, the preset value consists of two values, and the detecting mechanism determines whether or not the signal lies within a range specified by the two values.

Also preferably, the processor further comprises a mechanism for determining whether or not a sum of the postponed correction amount and the signal exceeds the preset value, a mechanism for modifying the sum to the preset value when the sum exceeds the preset value, a mechanism for calculating a difference between the sum and the preset value, and a mechanism for replacing the postponed correction amount by the difference.

According to an aspect of the invention, the signal processor is provided for use with an air flow meter which comprises a heating element wound on a ceramic bobbin and a circuit for supplying electrical current to the element. This element is exposed to an air flow and the current is controlled for maintaining the temperature of the element constant. The current is measured for detecting an air flowrate and then processed by the processor.

According to another aspect of the invention, the signal processor is provided for use with an air-fuel ratio controller for a lean burn engine. The engine is provided with an intake air passage comprising a throttle and a supplementary air passage bypassing the throttle, this supplementary air passage being provided with a flowrate control valve, a fuel injection valve for injecting fuel toward air drawn into the engine from the intake air passage. The controller is provided with a mechanism for detecting an amount of the intake air, a mechanism for calculating an amount of the fuel injection based on the intake air amount and a predetermined target air-fuel ratio, a mechanism for supplying the calculated fuel injection amount to the fuel injection valve, a mechanism for changing over the target air-fuel ratio according to running conditions of the engine, a mechanism for computing a target flowpath cross-sectional area of the flowrate control valve so that no torque fluctuation occurs when there is a change-over of the target air-fuel ratio, and a mechanism for controlling an opening of the flowrate control valve to the computed target flowpath cross-sectional area. The processor processes the target flowpath cross-sectional area which the computing mechanism of the controller has computed.

The details as well as other features and advantages of this invention are set forth in the remainder of the specification and are shown in the accompanying drawings.

DESCRIPTION OF THE PREFERRED EMBODIMENTS

Figure 1:
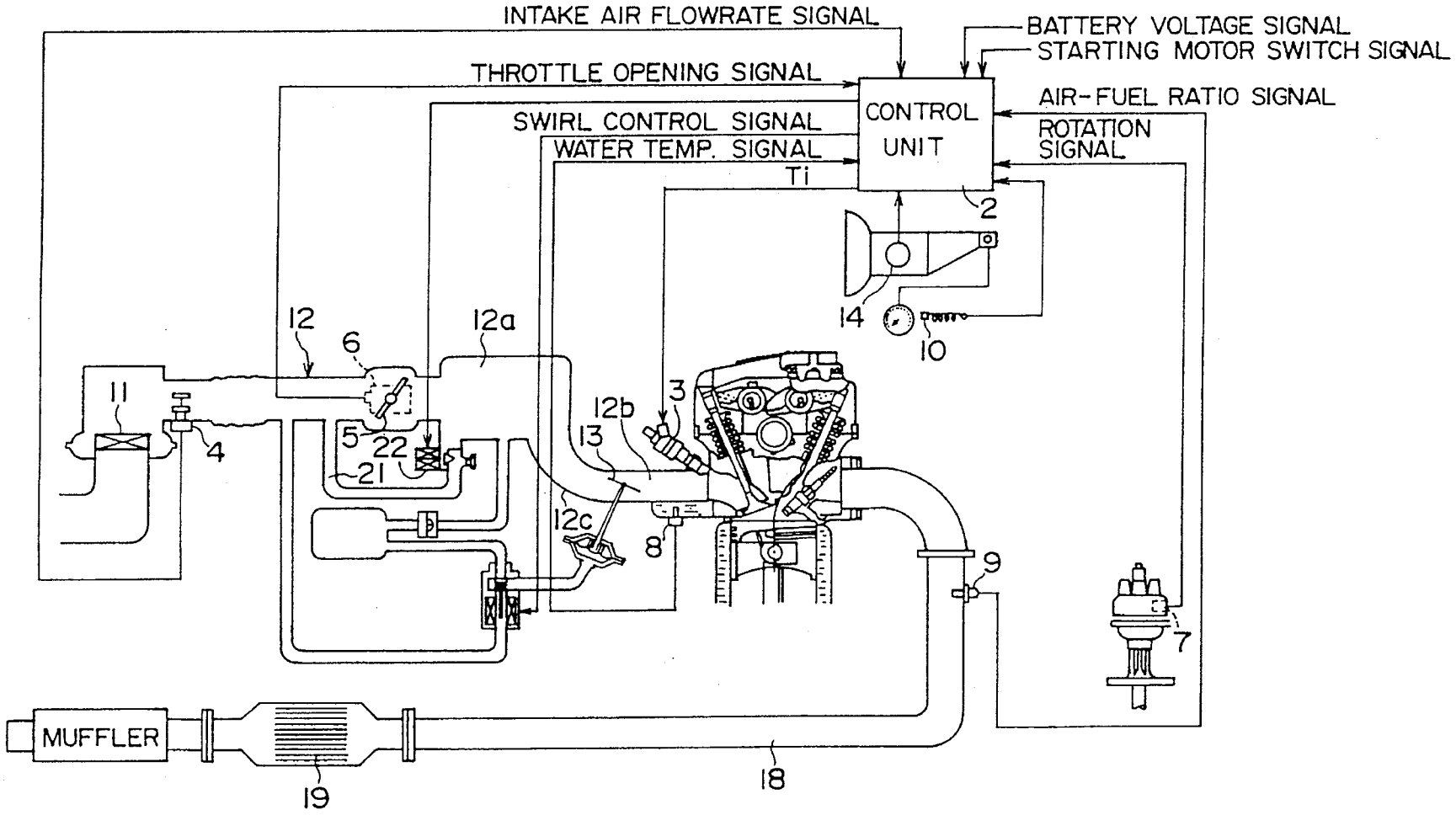
FIG. 1 is a schematic diagram of an air-fuel ratio controller according to this invention.

Referring to FIG. 1 of the drawings, air is drawn into an engine via an intake pipe 12. This air first passes an air cleaner 11, is then collected by a collector 12*a* having a predetermined capacity situated downstream of an air intake throttle 5, and enters cylinders of the engine via an intake manifold 12*c*. This engine is a lean burn engine for an automobile which performs lean combustion under predetermined conditions.

An injector 3 is installed in an intake port 12*b* of each cylinder of the engine, fuel being intermittently injected from the injector 3 in synchronism with the engine revolution. The fuel is mixed with intake air, and is ignited by a spark plug in the cylinder. The piston in the cylinder is pushed down by the combustion energy, burnt gases are led to a three-way catalytic converter 19 via an exhaust pipe 18, and after eliminating noxious components, the gases are discharged to the atmosphere.

The amount of intake air varies according to the opening of the throttle 5. A supplementary air passage 21 is further provided to bypass the air intake throttle 5 so as to control engine speed when the engine is running idle and prevent torque variations when there is a change-over of the air-fuel ratio, a flow control valve 22 being installed in this supplementary air passage 21.

The flow control valve 22 is a proportional solenoid type which varies according to an on duty proportion of the input signal. In order to perform proper torque control with some degree of flexibility when there is a change-over of air-fuel ratio, the flowrate control valve 22 is a high capacity type and is provided with a fail-safe function as described hereinafter to prevent faulty operation.

A swirl control valve 13 having a notch, not showing, is provided inside the intake manifold 12*c* near the intake port 12*b*. This swirl control valve 13 sets up a swirl in the air flowing into the cylinder so as to suppress generation of CO, HC in the lean air-fuel ratio region. In the lean air-fuel ratio region, the swirl control valve is fully closed so that air flows only through the notch, thus increasing the air flowrate and setting up a swirl.

A control unit 2 is provided to control the amount of fuel supplied from the injector 3, and the supplementary air flowrate through the flow control valve 22. Signals are input to the control unit 2 from sensors to detect engine running conditions in order to perform this control. These sensors comprise a hot wire type air flow meter 4 for detecting the air flowrate led from the air cleaner 11, a throttle sensor 6 for detecting the opening of the air intake throttle 5, a crank angle sensor 7 which outputs a signal for every rotation through unit crank angle and a Ref signal (signal output at fixed positions of the crankshaft), a water temperature sensor 8 for detecting cooling water temperature, a wide range air-fuel ratio sensor 9 for detecting the real air-fuel ratio over a wide range extending from the theoretical (stoichiometrlc) air-fuel ratio to a lean air-fuel ratio, a vehicle speed sensor 10 for detecting vehicle speed, and a gear position sensor 14 for detecting gear position. Also input to the control unit 2 are a battery voltage signal and an ON/OFF signal of a starting motor switch.

The controls performed by the control unit 2 may be broadly divided into: (1) control of flowrate through flow control valve 22, (2) setting of target air-fuel ratio, and (3) control of fuel injection amount.

These controls will now be described in detail with reference to the flowcharts, graphs and diagrams shown in FIG. 2 to FIG. 27.

(1) Control of flowrate through flow control valve 22

When the engine is running idle, the control unit 2 performs feedback control of the flow control valve 22 based on the detected engine speed so that the engine speed is a target engine speed. When there is a change-over of air-fuel ratio, it also performs a flowrate control on the flow control valve 22, so as to increase the intake air volume for the change-over of the air-fuel ratio from the theoretical air-fuel ratio to level, or so as to decrease the intake air volume when there is a change-over of the air-fuel ratio from lean to the theoretical air-fuel ratio. In this way, torque variations when there is a change-over of the air-fuel ratio are prevented.

(1-1) Idle speed control

Figure 14:
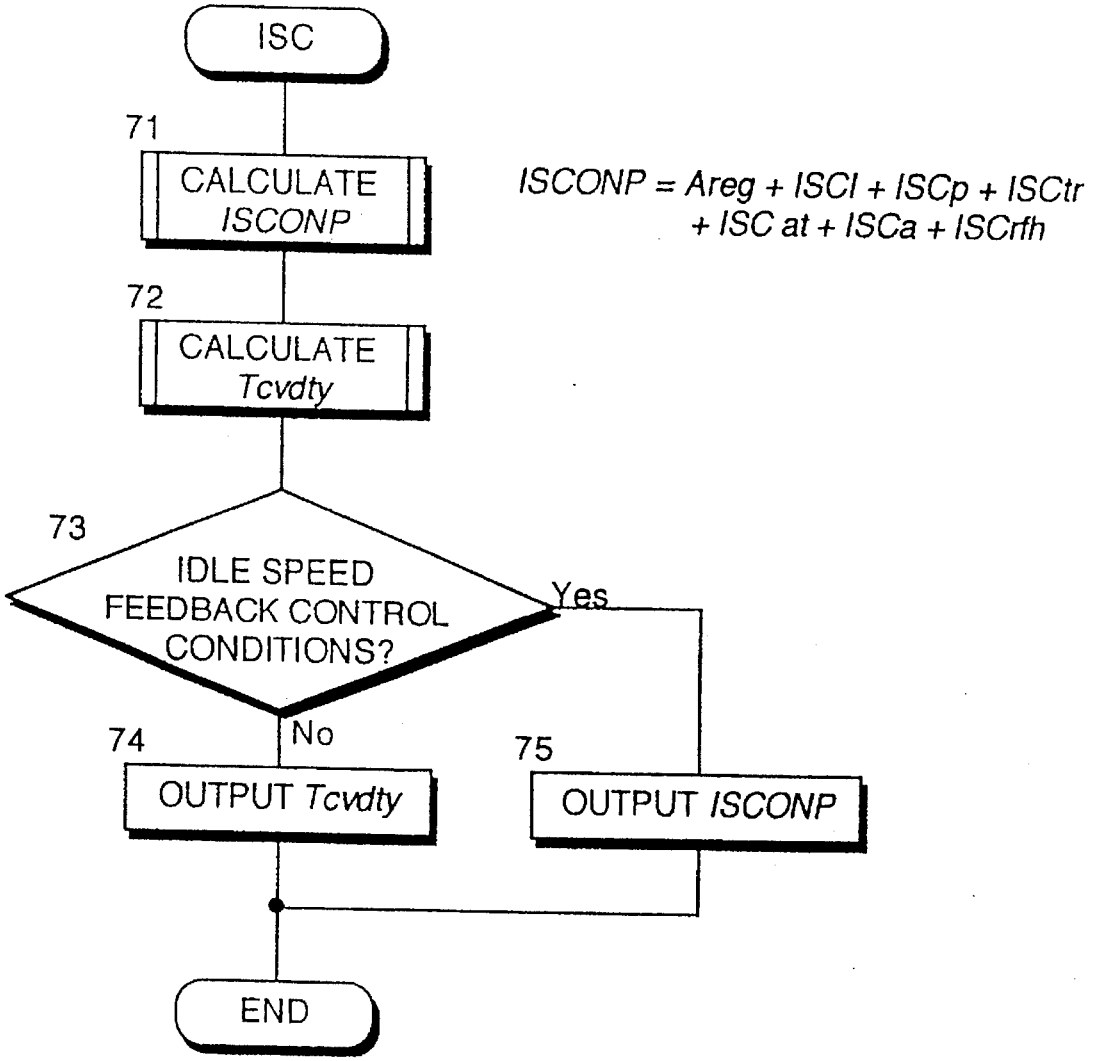
FIG. 14 is a flowchart showing a process of computing an on duty of the control valve according to this invention.

The control unit 2, as shown in FIG. 14, outputs an idle speed control duty ISCONP or a torque control duty Tcvdty depending on whether or not idle speed feedback control conditions are valid (steps 73, 74, 75). These duties are respectively calculated in steps 71, 72, all calculation results being expressed in the form of percentages.

The idle speed control duty ISCONP is calculated according to the following Equation [1]:

Equation [1]:

$$ISCONP=Areg+ISCcl+ISCtr+ISCat+ISCa+ISCrfn$$

where:

Areg=warm-up duty, i.e., for an air regulator

ISCcl=feedback correction coefficient

ISCtr=air amount increase during deceleration, i.e., for a dashpot

ISCat=N/D range correction for an automatic transmission vehicle (higher on D range)

ISCa=correction when air conditioner is ON

ISCrfn=correction when radiator fan is ON

On the first occasion after engine start-up, the warm-up duty Areg is a value found by looking up a table depending on the cooling water temperature at that time. Subsequently, this value is updated at regular intervals, e.g. every 1 second, by increasing or decreasing it, until warm-up is complete. This is done by comparing the table value depending on the cooling water temperature with the value obtained on the immediately preceding occasion. For example, if the value in the table>Areg on the immediately preceding occasion, Areg=Areg+1, alternatively if the value in the table<Areg on the immediately preceding occasion, Areg=Areg−1. Areg is expressed in the form of a percentage. The warm-up duty Areg has the same effect as that of an air regulator, so in this engine an air regulator is not provided.

(1-2) Feedback correction of idle speed

The target speed when the engine is running idle is determined based on the cooling water temperature, air conditioner switch, gear position of the automatic gear and the time elapsed after engine start-up. The flowrate through the flow control valve 22 is fine adjusted so that the engine speed is returned to a target value if it deviates from the target value by a predetermined amount, e.g. 25 rpm, under a feedback condition. This feedback correction condition may for example be either one of the following two conditions:

(A) Vehicle speed is less than 8 am/h and the intake air throttle is fully closed.

(B) Gear position is in neutral and the intake air throttle is fully closed.

The feedback correction amount ISCcl consists of an integral part ISCI and a proportional amount ISCp. When idle correction starts, if the idle speed deviates from the target value, the idle speed is returned to the target value by performing feedback correction. When the idle speed is returned to the target value, the feedback correction ISCcl has a certain value which is not zero. When the engine running conditions change to non-feedback control conditions, the feedback correction amount ISCcl is stored, and this stored value is used as the initial value for idle speed control when the conditions return to feedback correction conditions.

(1-3) Torque control duty Tcvdty

Figure 15A:
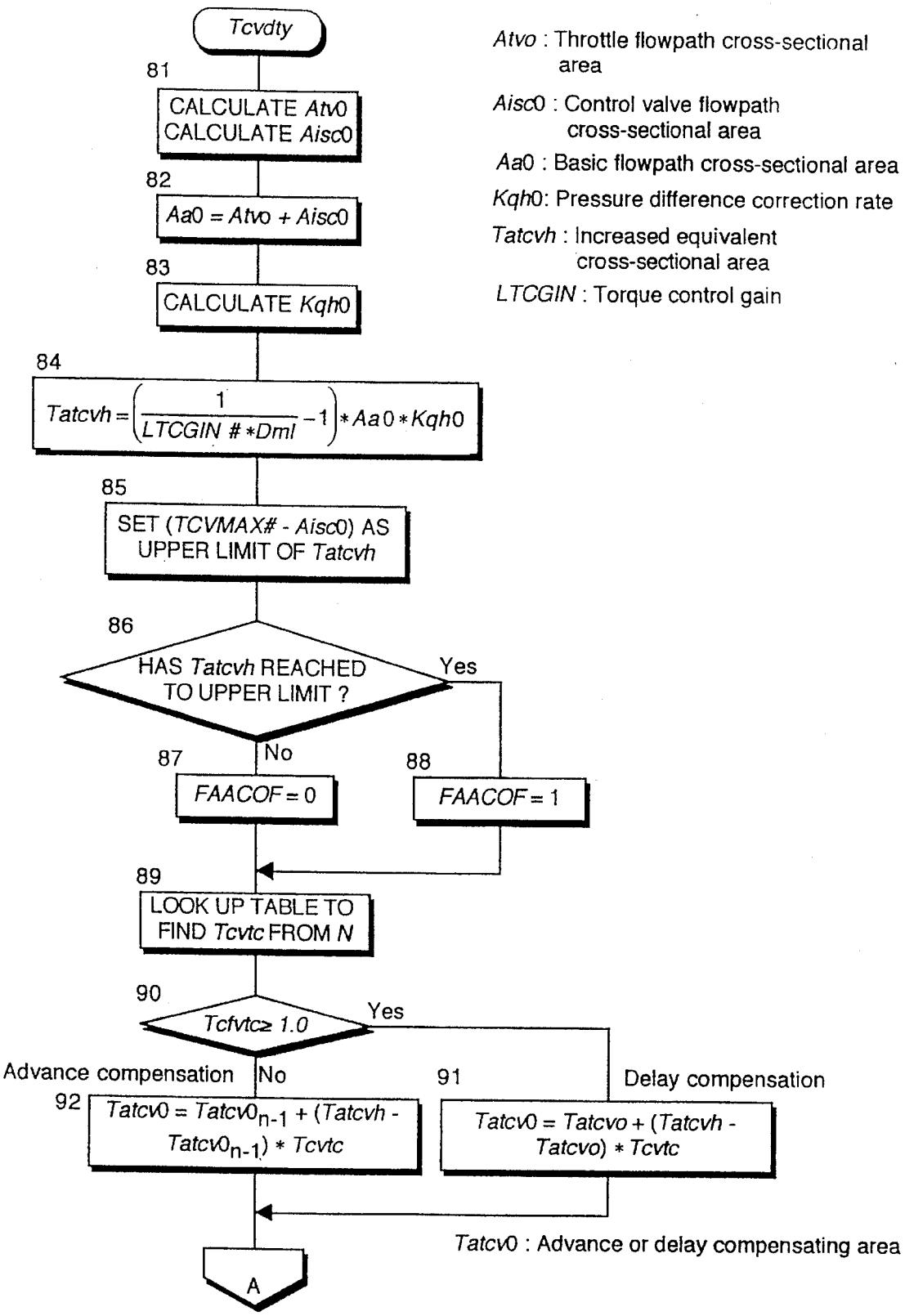
FIG. 15A and 15B are flowcharts showing a process of computing a torque control duty Tcvdty according to this invention.
Figure 15B:
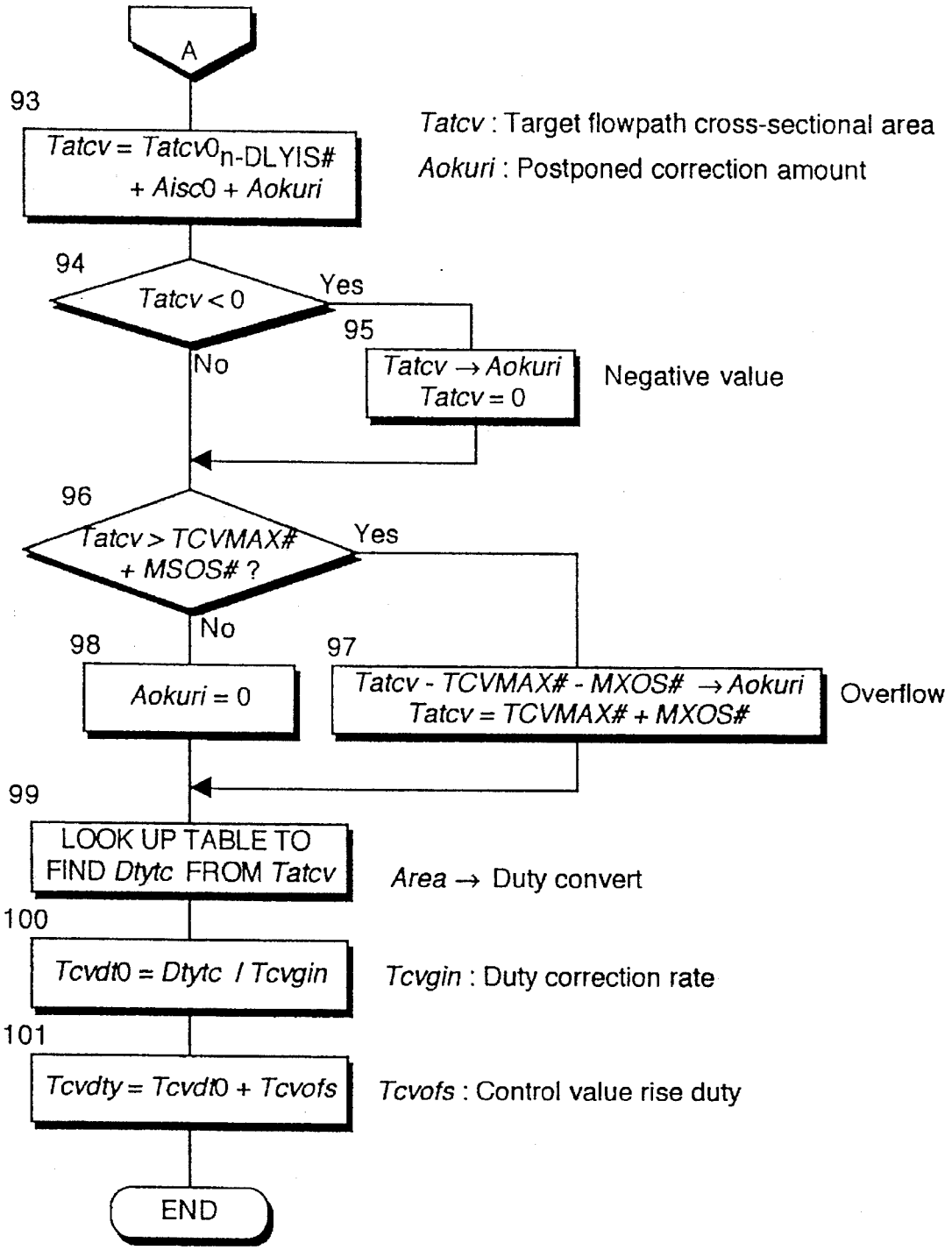
Figure 16:
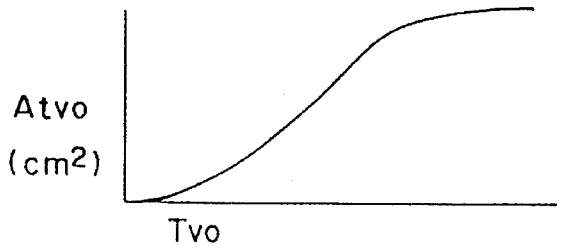
FIG. 16 is a graph showing contents of a table of a throttle flowpath cross-sectional area Atvo according to this invention.
Figure 17:
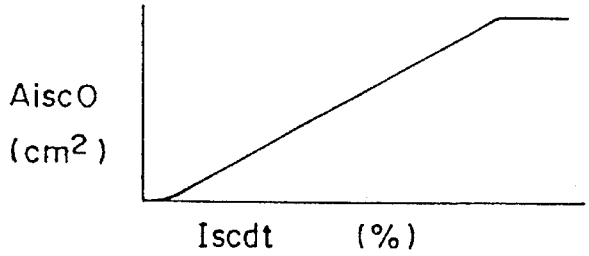
FIG. 17 is a graph showing contents of a table of a control valve flowpath cross-sectional area AiscO according to this invention.
Figure 18:
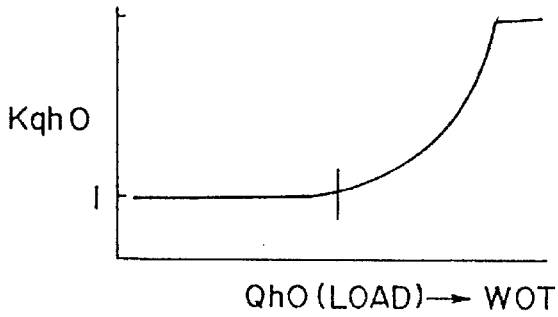
FIG. 18 is a graph showing contents of a table of a pressure difference compensating rate KghO according to this invention.

This calculation is performed by the subroutines shown in FIG. 15A and 15B. The calculation is executed every 10 ms. First, a throttle flowpath cross-sectional area Atvo is looked up from a table summarized in FIG. 16, and a control valve flowpath cross-sectional area AiscO is found by looking up a table summarized in FIG. 17 from a basic duty Iscdt shown below. The sum of these areas is entered as a basic flowpath cross-sectional area into a parameter AaO (steps 81, 82). The looking up of tables and maps actually includes some interpolation calculations, however in the following description this process will be referred to simply as looking up tables (maps).

The basic duty Iscdt is calculated by the following Equation [2].

Equation [2]:

$$Iscdt=(Iscdty-Tcvofs)*Tcvgin$$

where:

Iscdty=decrease amount basic duty

Tcvofs=control valve rise duty

Tcvgin=duty correction rate

The decrease amount basic duty Iscdty is a decrease correction applied by the following Equation [21] to the feedback correction amount ISCcl stored at the end of idle speed feedback correction oil the immediately preceding occasion.

Equation [21]:

$$Iscdty=ISCcl*Gistv$$

where:

Gistv=decrease correction rate (value between 0 and 1)

For the purpose of performing torque control when there is a change-over of air-fuel ratio, it is desirable to set the controllable range of the control valve 22 as wide as possible. However, if it is attempted to perform torque control simply by subtracting a stored feedback correction value when the engine is running idle from the maximum duty value of the control valve 22, the torque control range may be a narrow range depending on this stored value. Therefore, by using the stored value as an initial value when performing feedback control of the idle engine speed, and by applying a decrease correction to the stored value as described hereinabove when performing torque control, the torque control range can be maintained sufficiently wide without any loss of feedback control precision when the engine is running idle.

Figure 23:
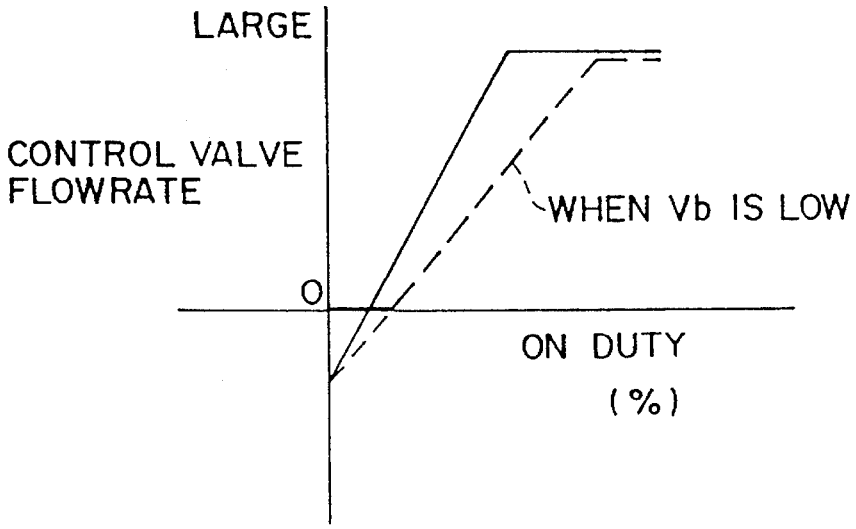
FIG. 23 is a graph showing characteristics of the control valve.

The control valve rise duty Tcvofs is a duty which assumes that the control valve 22 does not actually move until the on duty has reached a certain value as shown in FIG. 23. The control valve 22 is a proportional solenoid type valve, and as can be seen from this graph, the duty required to actually start the control valve 22 moving is higher the lower the battery voltage Vb. The control valve rise duty Tcvofs is therefore found by looking up a table summarized in FIG. 22 from the battery voltage V*b*.

The duty correction rate Tcvgin, as seen from the flowrate characteristics of FIG. 23, is a duty for correcting decrease of the positive slope of the line as the battery voltage Vb falls. It is found by looking up a table summarized in FIG. 21. Due to this correction, the control valve flowrate remains the same even if the battery voltage VD falls.

An increased equivalent cross-sectional area Tatcvh is found from the basic flowpath cross-sectional area AaO by means of the following Equation [3] (step 84):

Equation [3]:

$$Tatcvh=AaO*KqhO*\{1/(Dml*LTCGIN\#)-1\}$$

where:

KqhO=pressure difference correction rate

LTCGIN#=torque control gain

Dml=target air-fuel ratio damped response value

The more the load is, the less the pressure difference across the throttle 5 and control valve 22 is. The pressure difference correction rate KqhO compensates for this phenomenon and resultant decrease of flow rate KqhO is found by looking up a table summarized in FIG. 18 from a linearized flowrate Qh determined by a throttle opening Tvo, engine speed N and cylinder capacity V (step 83). The torque control gain LTCGIN# is a constant necessary for matching.

The basic concept of Equation [3] is described in the following Equation [3A].

Equation [3A]:

$$Tatcvh=AaO*\{(1/TDml)-1\}$$

where,

Tdml=target fuel-air ratio map value.

The fuel-air ratio used here is not merely the reciprocal of the air-fuel ratio but a relative value based on the theoretical fuel-air ratio being 1.0, so the expression {1/Tdml)−1} corresponds to the difference between the target air-fuel ratio and the theoretical air-fuel ratio. The value obtained by multiplying this by the total flowpath cross-sectional area AaO represents the duty of the increased cross-sectional area when there is a change-over to a lean air-fuel ratio, or the decreased cross-sectional area when there is a change-over to the theoretical air-fuel ratio. For example, the map value Tdml of the target fuel-air ratio is 1 for the theoretical air-fuel ratio (=14.5), and effectively 0.66 for a lean air-fuel ratio (=20).

When 1.0 is entered for Tdml, Tatcvh=0, and when 0.66 is entered for Tdml, Tatcvh=(1/0.66)-1≈0.52. The value (0.52-0)*AaO is then the increase of cross-sectional area when there is a change-over from the theoretical air-fuel ratio to a lean air-fuel ratio. Equation [3A] however is a theoretical equation, and Equation [3] is used for the actual calculation. The upper limit of the increased equivalent cross-sectional area Tatcvh is limited to a value obtained by subtracting the aforesaid control valve flowpath cross-sectional area AiscO from the flowpath cross-sectional area TCVMAX# when the flow through the control valve 22 is a maximum (step 85). When Tatcvh>TCVMAX#-AiscO, i.e. when Tatcvh exceeds its upper limit, a flag FAACOF is set equal to 1 (steps 86, 88 in FIG. 15A). The purpose of the flag FAACOF is to make the speed at which the damped response value Dml changes variable, this speed being slower when FAACOF=1. This is due to the following reason. The setting of the control valve 22 cam be changed up to the point when the increased equivalent cross-sectional area Tatevh reaches its upper limit, so the control valve 22 can respond even if Dml changes very rapidly. On the other hand, if the increased equivalent cross-sectional area Tatcvh exceeds its upper limit, the control valve 22 can no longer respond, so the speed at which Dml changes must be suppressed to prevent sudden changes of torque.

An advance compensated cross-sectional area with respect to the increased equivalent cross-section Tatcvh is also found by the following Equation (4) (step 91 ).

Equation [4]:

$$TatcvO=Tatcvo+(Tatcvh-Tatcvo)*Tcvtc$$

where,

Tatcvo=immediately preceding value of Tatcvh

Tcvtc=advance compensating time constant corresponding value (value greater than 1)

In MPI (Multi-Point Injection Systems) of the type in this example, where the capacity of the intake pipe downstream of the control valve 22 is high, air in the pipe is delayed more than fuel. Air is therefore speeded up to match the fuel which has a better response so that air and fuel reach the cylinder in phase.

In SPI (Single Point Injection Systems) on the other hand, where the capacity of the intake pipe downstream of the control valve is small, fuel enters the cylinder later than air, so the flow of air to the cylinder is delayed. For this purpose, a delay compensated cross-sectional area is found using the following first order delay Equation [5] so that air and fuel reach the cylinder in phase.

Equation [5]:

$$TatcvO=TatcvO_{n-1}(\text{Tatcvh}-\text{TatcvO}_{n-1})*Tcvtc$$

where, $\text{TatcvO}_{n-1}$=immediately preceding value of TatcvO

Tcvtc=delay compensating time constant corresponding value (value less than 1)

The flowcharts of FIG. 15A and 15B cam be applied either to a MPI system with large intake pipe capacity, or an SPI system with small intake pipe capacity. It is therefore determined whether or not Tcvtc≧1.0. When Tcvtc≧1.0, it is determined that the engine has a high intake pipe capacity and the aforesaid first order advance equation is applied; conversely, when Tcvtc<1.0, the first order delay equation is applied (steps 90, 91, steps 90, 92).

Figure 19:
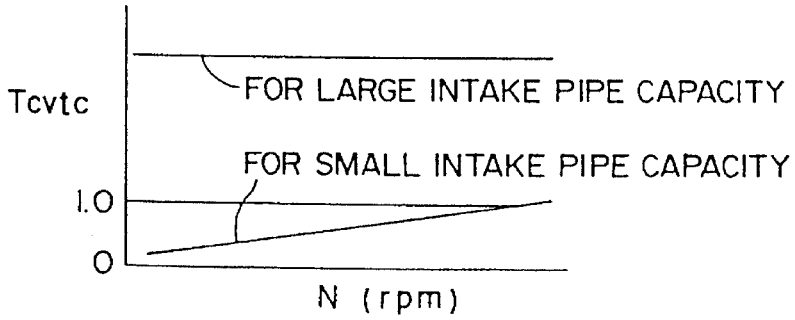
FIG. 19 is a graph showing contents of a table of a delay/advance compensating time constant corresponding value Tcvtc according to this invention.

The advance compensating or delay compensating time constant corresponding value Tcvtc is found by looking up a table summarized in FIG. 19 from the engine speed N (step 89). In FIG. 19, two types of characteristics are shown depending on the magnitude of the intake pipe capacity, but in the engine of this embodiment shown in FIG. 1, the characteristic for small intake pipe capacity is not necessary.

The target flowpath cross-sectional area Tatcv is then found from the advance compensating or delay compensating cross-sectional area TatcvO determined as described hereinabove, by means of the following Equation [6] (step 93 in FIG. 15B).

Equation [6]:

$$Tatcv=TatcvO_{n-DLYIS}+AiSCO+Aokuri$$

$\text{TatcvO}_{n-DLYIS}$ is the value of the advance or delay compensating cross-sectional area TatcvO on a predetermined previous number DLYIS# of occasions. This is in order to allow for the dead time from when a valve open signal is sent to the injector 3 to when the injector 3 actually begins to open.

However, if Tacv<0, the minimum result for Tactv as computed by the above equation is limited to 0 (steps 94, 95); conversely, if Tactv>TCVMAX#+MXOS#, the xnaxlmum result is limited to the value TCVMAX# obtained by adding the flowpath cross-sectional area when the flowrate through the control valve is a maximum and the extra fraction MXOS# to allow for advance compensation, i.e., Tatcv=TCVMAX#+MXOS#(steps 96, 97).

Figure 20:
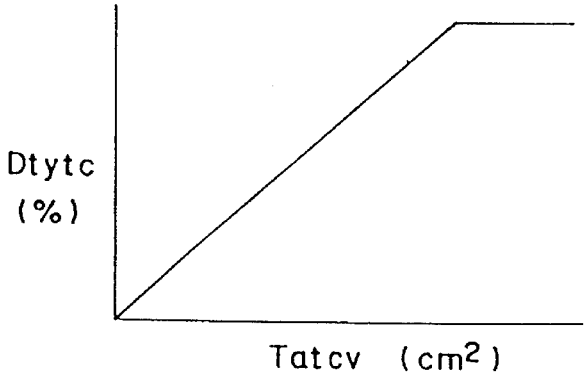
FIG. 20 is a graph showing contents of a table of a basic duty Dtytc according to this invention.
Figure 21:
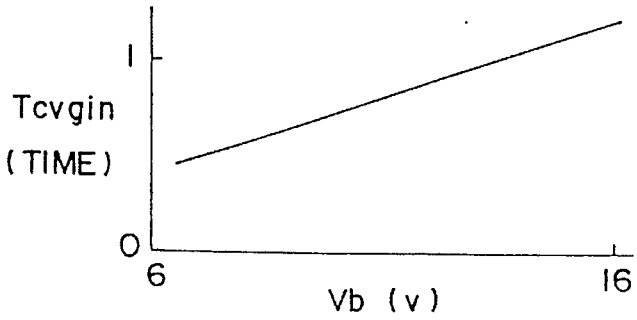
FIG. 21 is a graph showing contents of a table of a duty correction rate Tcvgin according to this invention.
Figure 22:
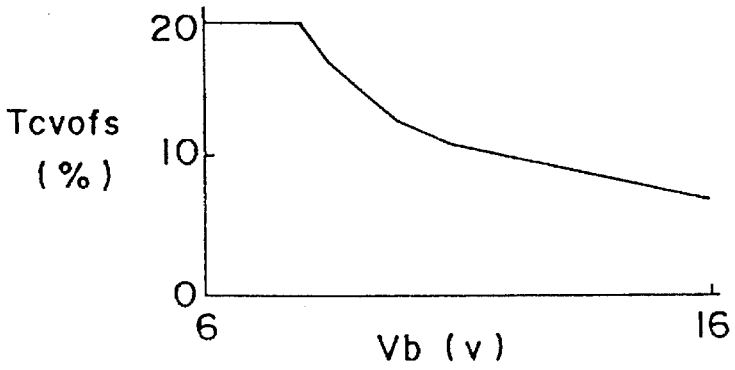
FIG. 22 is a graph showing contents of a table of a control valve rise duty Tcvofs according to this invention.

The target flowpath cross-sectional area Tatcv thus obtained is converted to a duty Dtytc by looking up a table summarized in FIG. 20 (step 99).

A torque control duty Tcvdty is then calculated by the following equation [7] (steps 100, 101).

Equation [7]:

$$Tcvdty=Dtytc/Tcvgin+Tcvofs$$

where, Tcvgin=duty correction rate

Tcvofs=control valve rise duty

The control valve rise duty Tcvofs and the duty correction rate Tcvgin were described with reference to Equation [2].

Further, in the above steps 94, 95 and 96, 97, the fractions which were outside the preset range of the target flowpath cross-sectional area Tatcv were discarded. However, to retain these fractions in the memory, the value of Tatcv when Tatcv<0 is stored in a parameter Aokuri (steps 94, 95). Likewise, when Tatcv>TCVMAX#+MXOS#, the value of Tactv–(TCVMAX#+MXOS#), i.e. the overflow, is stored in the parameter Aokuri (steps 96, 97).

When Tatcv does not have a negative value, and there is also no overflow, Aokuri is set equal to 0 (steps 94, 96, 98).

These stored discarded fractions are taken into account on the next occasion, i.e. in the computation of Tatcv 10 ms later, by adding Aokuri to the right-hand side of the above equation [6]. If the computation result of Equation [6] is again Tatcv<0 as on the previous occasion, negative values of Tatcv are again discarded, and the discarded values are entered in Aokuri (steps 94, 95). In other words, the current discarded part is postponed until a subsequent occasion when Tatcv >0, the parameter Aokuri being this postponed part. The computation result of Equation [6A] is treated in the same way when Tatcv>TCVMAX#+MXOS#.

(2) Setting of target air-fuel ratio

The target air-fuel ratio is found via the sequence:

Map value of Tdml→Damped response value Dml→Damper value Kmr.

Figure 6:
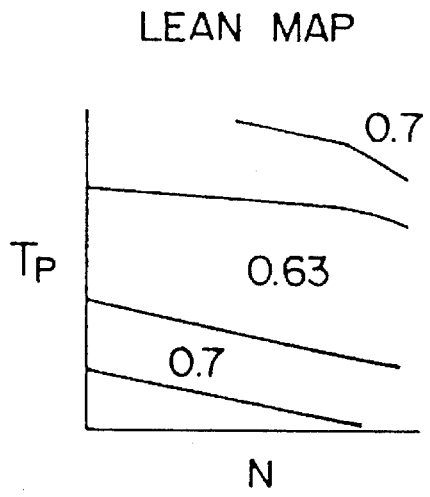
FIG. 6 is a lean map of a lean target air-fuel ratio MDMLL according to this invention.
Figure 7:
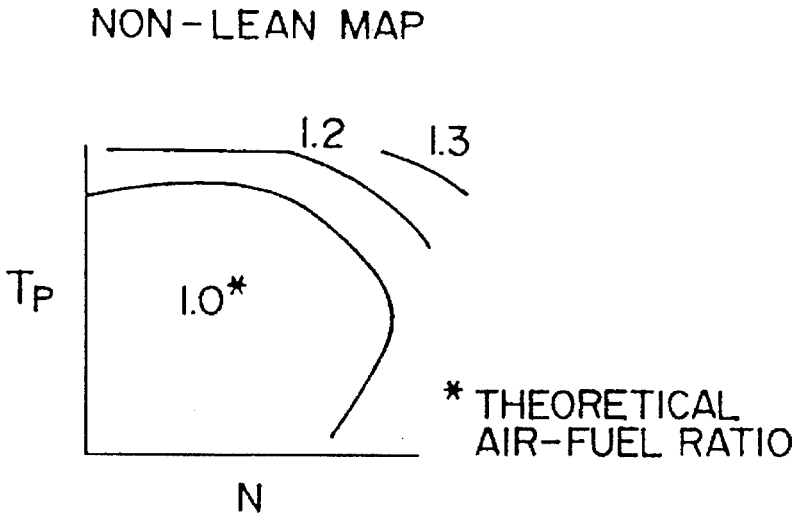
FIG. 7 is a non-lean map of a non-lean target air-fuel ratio MDMLS according to this invention.
Figure 8:
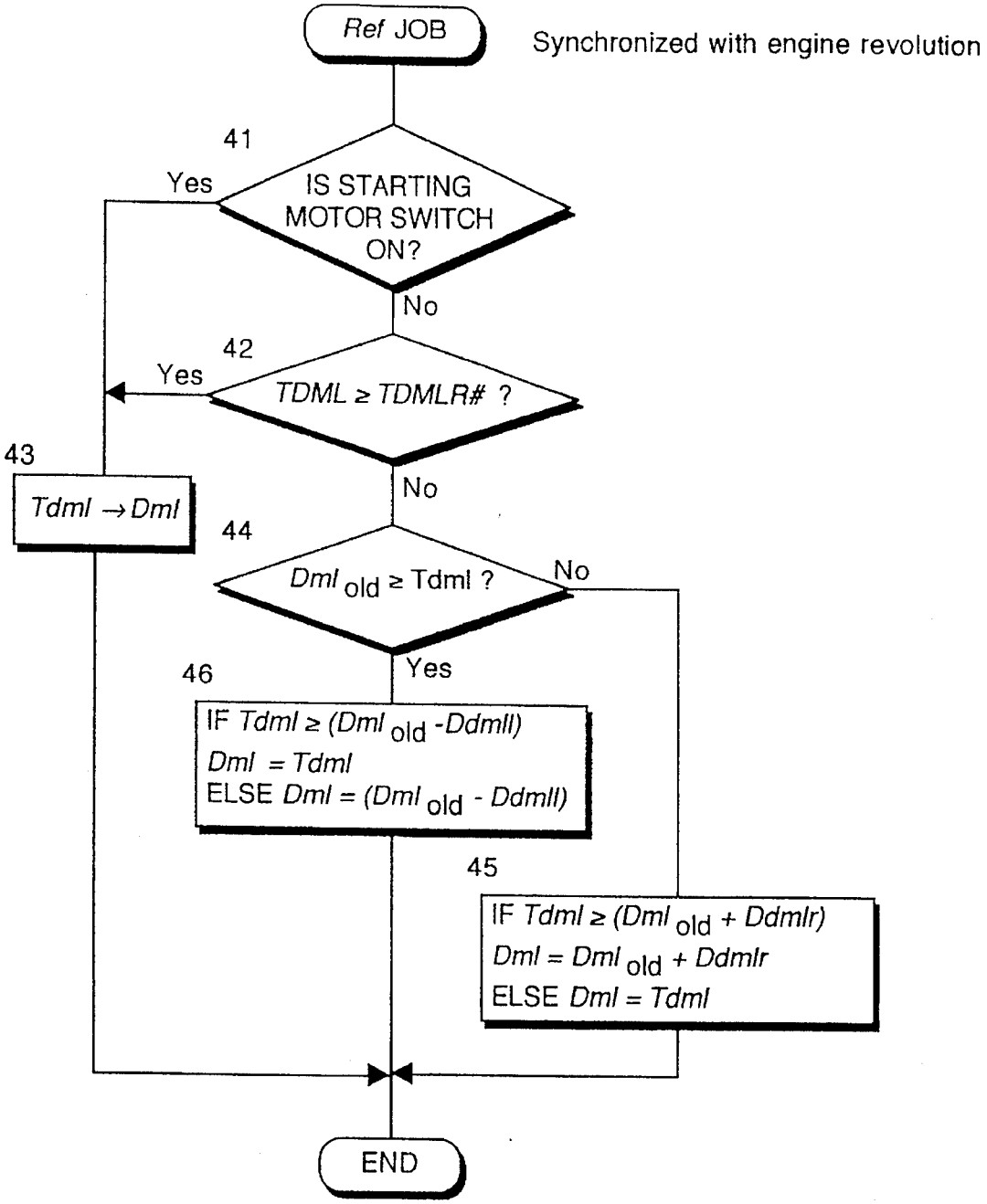
FIG. 8 is a flowchart showing a process of computing a damped response value Dml according to this invention.

(2-1) Map value Tdml of target air-fuel ratio As shown by the steps 31, 33 in FIG. 6, if the conditions are lean, a target air-fuel ratio MDMLL is found by looking up a lean map in FIG. 6, and if the conditions are not lean, a target value MDMLS is found by looking up a non-lean map in FIG. 7. The found value is then entered in the parameter Tdml as a map value of the target air-fuel ratio (step 34).

The values MDMLL, MDMLS which are used here as target air-fuel ratio map values are not actual air-fuel ratios, but relative values based on the theoretical air-fuel ratio as 1.0 as shown m FIG. 6 and 7.

(2-2) Damped response value Dml of the target air-fuel ratio

Figure 9:
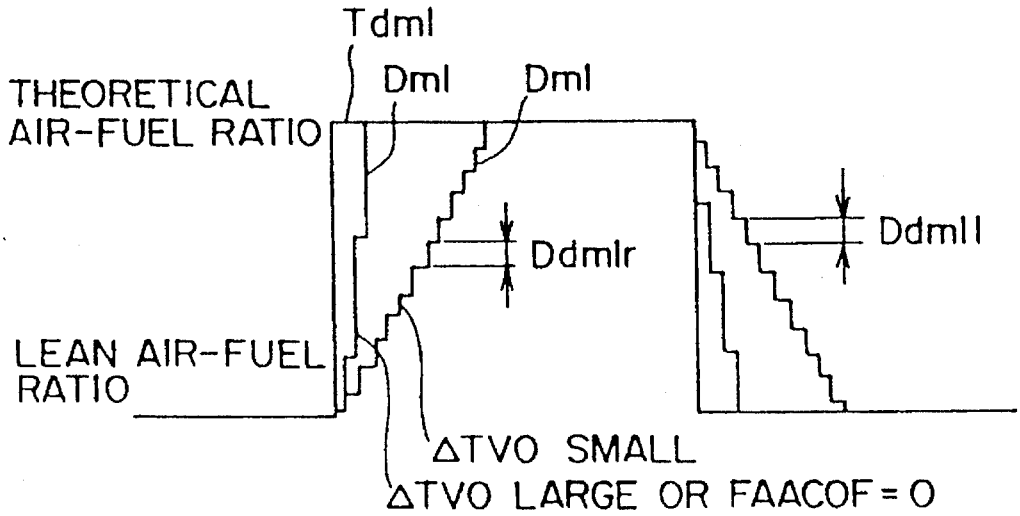
FIG. 9 is a diagram showing characteristics of the damped response value Dml.

As might be expected from its name, the waveform of a damped response value Tdml is a value obtained by damping the map value Tdml which varies in a stepwise fashion so that it varies in small steps or stages, as shown in FIG. 9. The reason why the air-fuel ratio is changed over in stages in this way is so that sudden changes of air-fuel ratio will not impair drivability, however from the viewpoint of exhaust gas purification, change-over of air-fuel ratio should be performed in as short a time as possible.

If Dml on the immediately preceding occasion is set to $\text{Dml}_{old}$ it can be known whether the air-fuel ratio is changing in the direction of rich or lean by comparing $\text{Dml}_{old}$ and Tdml. More specifically, if $\text{Dml}_{old}$<Tdml, the air-fuel ratio is changing towards rich, while if $\text{Dml}_{old}$>Tdml, it is changing towards lean.

If the rate of variation of the air-fuel ratio towards lean is Dmll and its rate of variation towards rich is Dmlr, then if $\text{Dml}_{old}$<Tdml, a damped response value is obtained by entering the smaller of the two values Tdml and ($\text{Dml}_{old}$+Ddmir) in Dml (steps 44, 45).

Conversely, if $\text{Dml}_{old}$≧Tdml, a damped response value is obtained by entering the larger of the two values Tdml and ($\text{Dml}_{old}$–Dmll ) in Dml (steps 44, 46).

The activity of the catalytic converter with regard to elimination on NOx is better when changing over from the theoretical air-fuel ratio to a lean air-fuel ratio than when changing over in the reverse direction. In this case, even if the change-over is performed slowly, it does not usually lead to a worsening of exhaust gas composition, so Ddmll may be set less than Ddmlr.

If either one of the following conditions (i), (ii) is satisfied, the damped response value Dml is set equal to Tdml (steps 41, 42, 43):

(i) The starting motor switch is ON (ii) Tdml≧an upper limit TDMLR

The damped response value Dml is calculated in synchronism with the engine speed, i.e. in synchronism with a Ref signal. This is in order to make the exhaust characteristics of the engine vary in synchronism with the engine speed.

Figure 10:
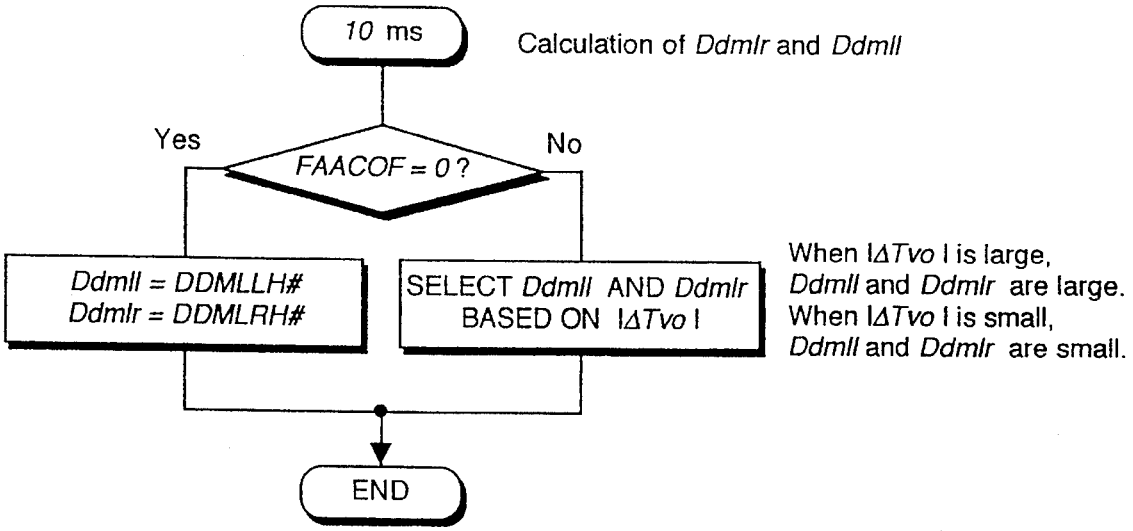
FIG. 10 is flowchart showing a process of computing variation rates Ddmir and Ddmir according to this invention.

FIG. 10 is a subroutine to find the above two variation rates Ddmll, Ddmlr. To speed up the change-over of air-fuel ratio before the increased equivalent cross-sectional area Tatcvh reaches Rs upper or lower limit, i.e. when the flag FAACOF=0, predetermined large values DDMLL#, DDMLRH# are entered in the parameters Ddmll, Ddmlr (steps 51, 52).

After the increased equivalent cross-sectional area Tatcvh has exceeded its upper or lower limit, i.e. when the flag FAACOF=1, a value corresponding to an absolute value |ΔTvo| of the throttle opening variation is selected and set equal to the parameters Ddmll, Ddmlr (steps 51, 53).

In the case of Ddral, for example, a predetermined value DDMLL0# is selected when |ΔTvo|<DTVO1#; a predetermined value DDMLL1# is selected when ΔTVO1#≦|ΔTvo|<ΔTVO2#; a predetermined value DDMLL2# is selected when ΔTVO2#≦|ΔTvo|<ΔTVO3#; and a predetermined value DDMLL3# is selected when ΔTV03#≦|ΔTvo|, it being specified that DDMLL0#<DDMLL1#<DDMLL2#<DDMLL3#<DDMLLH#. For Ddmir, the same procedure is followed.

(2-3) Damped value Kmr of target air-fuel ratio

Figure 11:
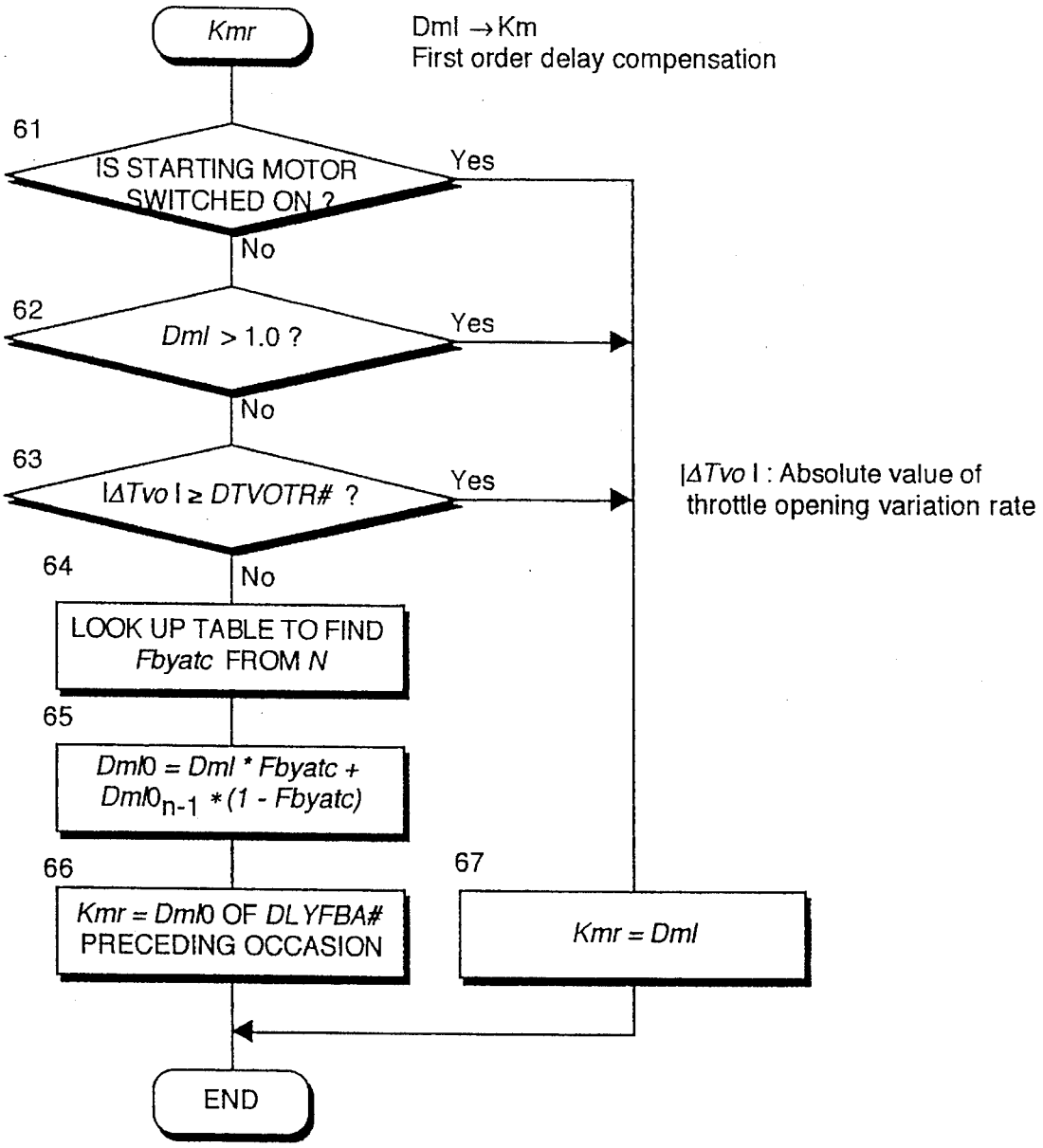
FIG. 11 is a flowchart showing a process of computing a damper value Kmr according to this invention.

A first order delay is applied to the damped response value Dml, as shown in the flowchart of FIG. 11, by means of the following equation [9].

Equation [9]:

$$Dmlo=Dml*Fbyatc+Dmlo_{n-1}*(1-Fbyatc)$$

where,

Fbyatc=delay time constant corresponding value (value less than 1).

If the target air-fuel ratio is delayed by this equation, the final result is that fuel supply is delayed. In the MPI system where the intake pipe capacity is large, a delay in the increase of the supplementary air flowrate occurs. However, by delaying the fuel supply as described hereinabove, fuel and air reach the cylinder in phase when there is a change-over of the air-fuel ratio.

Figure 13:
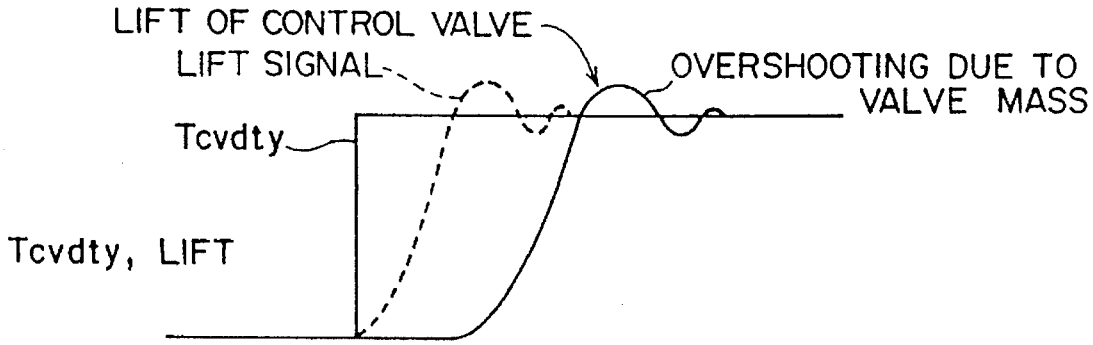
FIG. 13 is a diagram showing a dead time of a control valve according to this invention.

For the damped value Dmlo in equation [9], values up to the third preceding occasion are stored, and the value on a predetermined number DLYFBA# of preceding occasions is entered in the parameter Kmr (step 66 in FIG. 11). The reason why the value for the DLYFBA# preceding occasion is used is in order to take account of the delay in the action of the control valve 22, i.e. the dead time, as shown in FIG. 13.

However, if any of the following conditions (i), (ii), (iii) are satisfied, delay processing is not performed:

(i) The starting motor switch is ON (ii)Dml>1.0

(iii) |ΔTvo|≦DTVOTR#(predetermined value)

Figure 12:
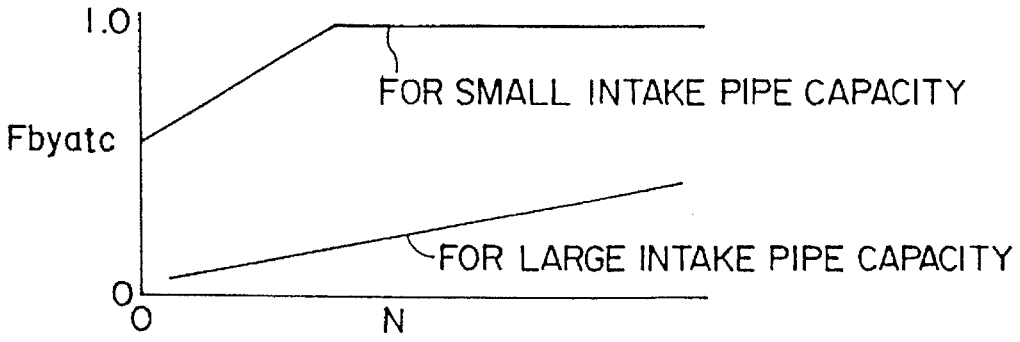
FIG. 12 is a graph showing contents of a table of a delay time constant corresponding value Fbyatc according to this invention.

The delay time constant corresponding value Fbyatc in Equation [9] is found by looking up characteristics when the intake pipe capacity is large from a table summarized in FIG. 12 (step 64). The delay in the increase of air flowrate when there is a change-over of air-fuel ratio, increases the lower the engine speed N. The value of Fbyatc is therefore set depending on the engine speed N as shown in FIG. 12. However, for engines having a small air pipe capacity, Fbyatc varies depending on the engine speed N in the low speed region only.

In FIG. 12, characteristics for small intake pipe capacity are also shown. These characteristics correspond to engines using the SPI system where the intake pipe capacity is small. In this case, air has a better response than fuel so there is no need to delay the fuel, and Fbyatc is set equal to 1.0 excepting in the low speed region.

One set of characteristics which is unnecessary is therefore deleted from the contents of the table in FIG. 12 according to the magnitude of the intake pipe capacity of the engine actually installed, and the flowchart in FIG. 11 is used for both the MPI and SPI systems.

When there is a change-over of air-fuel ratio in the MPI system where the intake pipe capacity is large, the increased supplementary air flowrate can be made to coincide in phase with the fuel supply by either one of two methods: (a) delaying the change of fuel supply amount to coincide with the increase of supplementary air flowrate, and (b) advancing the increase of supplementary air flowrate to match the fuel supply amount.

For the sake of clarity, both these two methods are integrated into (a) steps 90, 91, 92 in FIG. 15A and (b) steps 64, 65 in FIG. 11, although only one method is actually used and the method which is not used is deleted.

(2-4) Target air-fuel ratio Tfbya

Figure 5:
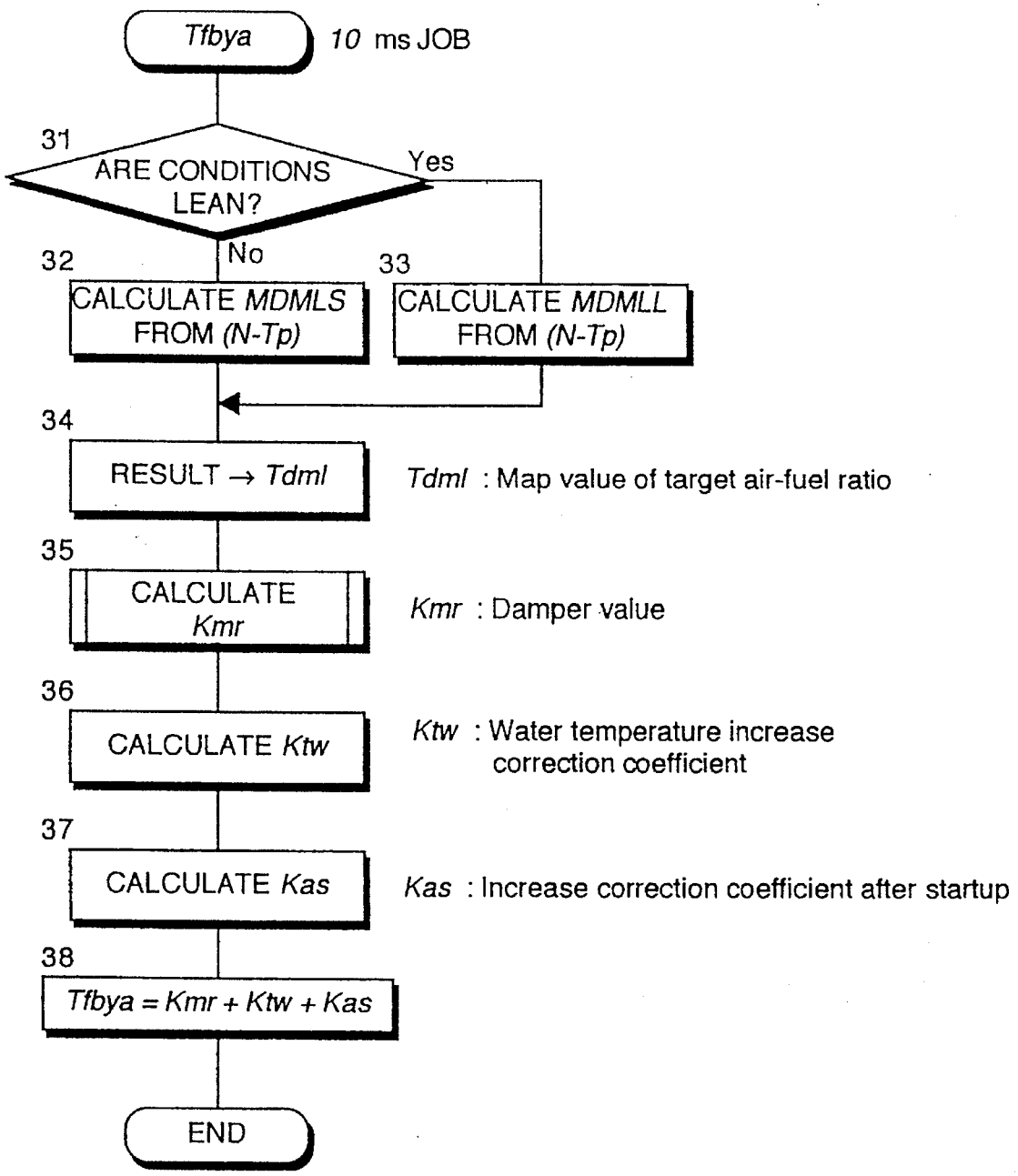
FIG. 5 is a flowchart showing a process of computing a target air-fuel ratio Tfbya according to this invention.

This is calculated according to the flowchart shown in FIG. 5 by means of the following Equation [8].

Equation [8]:

$$Tfbya=Kmr+Kas+Ktw$$

where,

Kmr=damped value of target air-fuel ratio

Kas=increase correction coefficient after start-up

Ktw=water temperature increase correction coefficient

The increase correction coefficient after start-up Kas is determined according to the cooling water temperature while the engine is starting up, and decreases depending on the time elapsed from immediately after start-up. The water temperature increase correction coefficient Ktw is found by looking up a table of cooling water temperature (steps 37, 36).

(3) Injection amount control (3-1) Fail-safe of control valve 22

Figure 4:
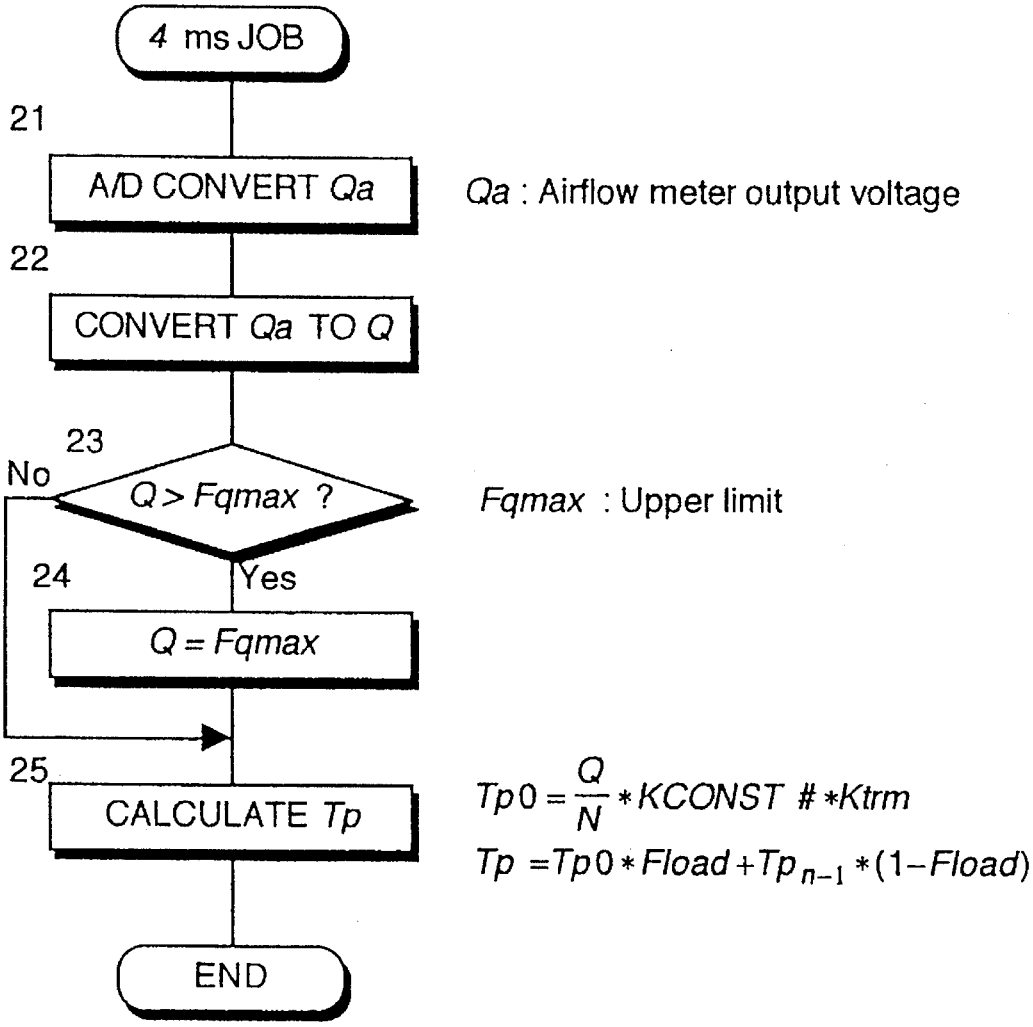
FIG. 4 is a flowchart showing the process of computing a basic fuel injection pulse width Tp according to this invention.

As shown in FIG. 4, the output voltage Qa of the air flow meter 4 is A/D converted, and then converted to air flowrate units by looking up a table (steps 21, 22 in FIG. 4). The upper limit of the air flowrate Q obtained by conversion is limited to Fqmax (steps 23, 24). This limit is provided to prevent supplementary air from flowing into the cylinder at a high flowrate, thereby generating more torque than is required by the driver, when the high flowrate control valve 22 operates in a faulty manner.

Figure 24:
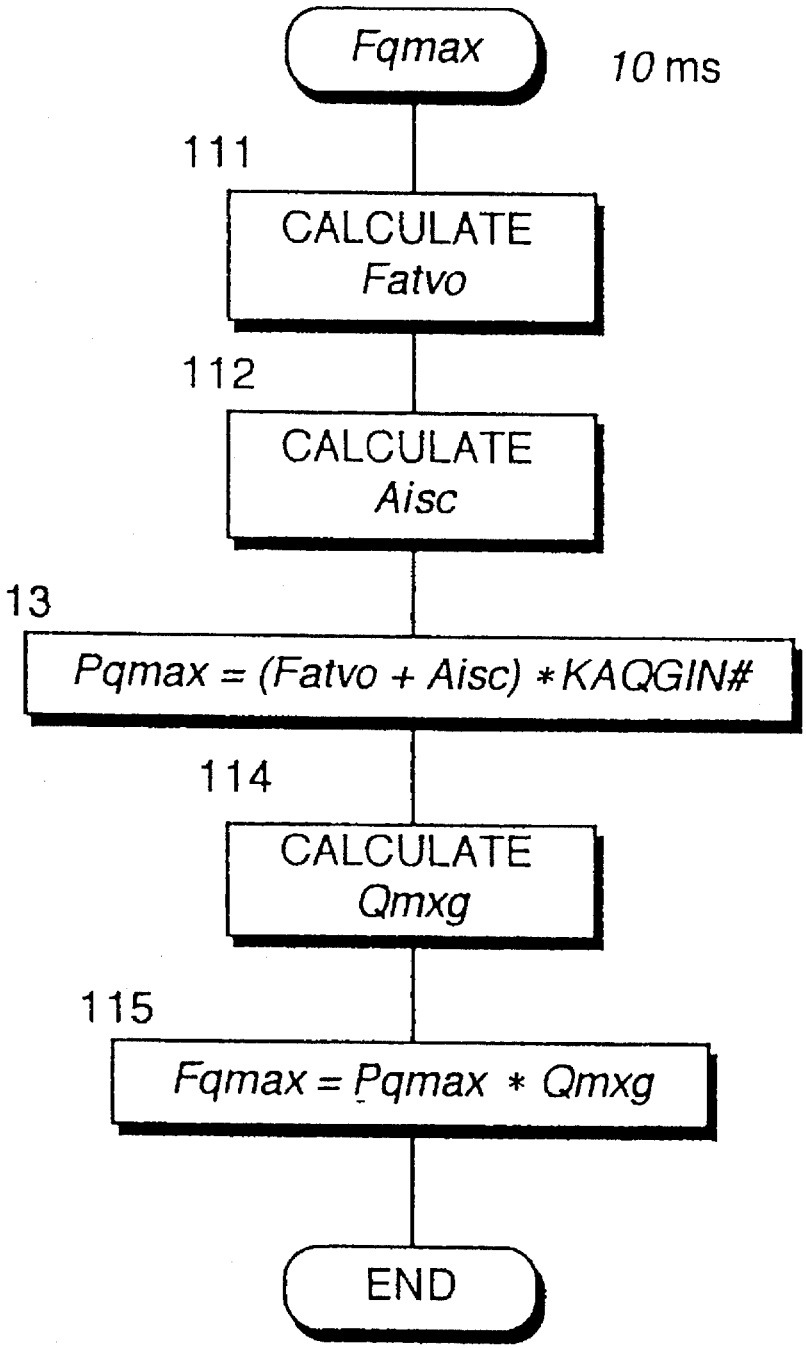
FIG. 24 is a flowchart showing a process of computing an upper limit Fqmax according to this invention.

The upper limit Fqmax is determined according to a flowchart shown in FIG. 24. First, a throttle valve flowpath cross-sectional area FAtvo is found by looking up the contents of a table in FIG. 25 (step 111). Next, a predicted value Aisc of the control valve flowpath cross-sectional area when the control valve 22 operates correctly is found by looking up a table summarized in FIG. 26 (step 112).

Figure 25:
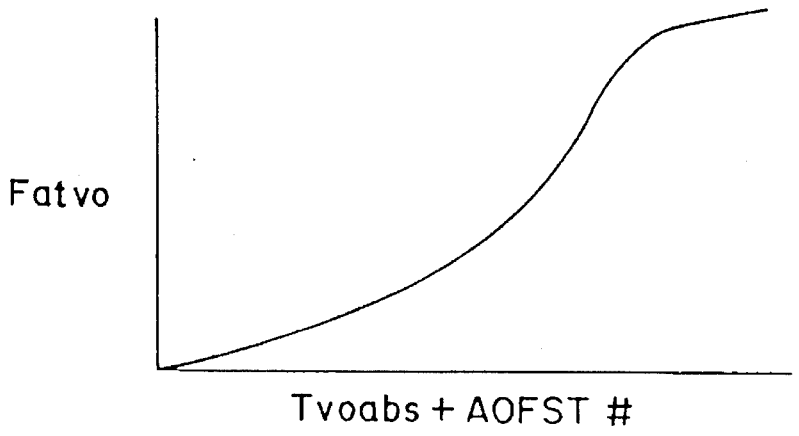
FIG. 25 is a graph showing contents of a table of a throttle flowpath cross-sectional area FAtvo according to this invention.

Tvoabs on the horizontal axis of FIG. 25 is a value obtained by subtracting Tvo when the throttle is fully closed from the throttle valve opening Tvo. AOFST# is an offset amount to make the throttle opening correspond to the actual air flowrate.

Figure 26:
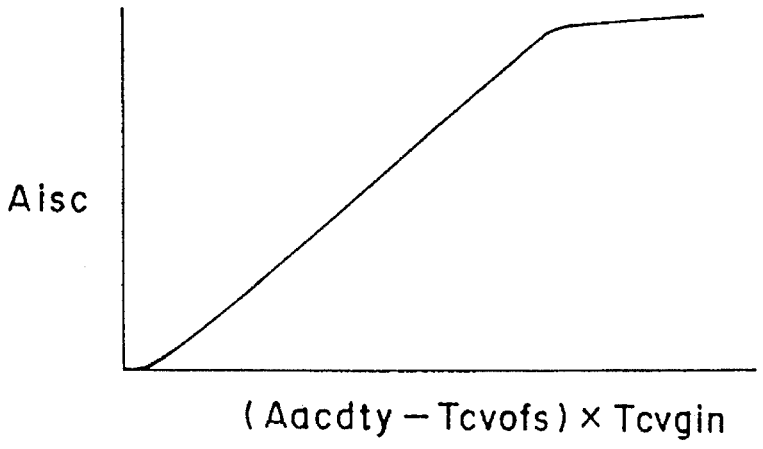
FIG. 26 is a graph showing contents of a table of a prediction value Aisc of the control valve flowpath cross-sectional area according to this invention.

For Aacdty oil the horizontal axis of FIG. 26, the value of either an idle speed control duty ISCONP or a torque control duty Tcvdty is used.

The flowpath cross-sectional area, which is the sum of the throttle valve flowpath cross-sectional area FAtvo and the predicted value Aisc of the control valve flowpath cross-sectional area, (FAtvo+Aisc), is converted to air flowrate units by means of the following Equation [10] (step 113).

Equation [10]:

$$Pqmax=(FAtvo+Aisc)*KAQGIN\#$$

where,

KAQGIN#=constant

Pqmax is a predicted value of the total intake air flowrate when the control valve 22 is operating correctly.

An upper limit Fqmax is found frown this predicted value Pqmax by means of the following equation [11] (step 115).

Equation [11]:

$$Fqmax=Pqmax*Qmxg$$

where,

Qmxg=gain.

Figure 27:
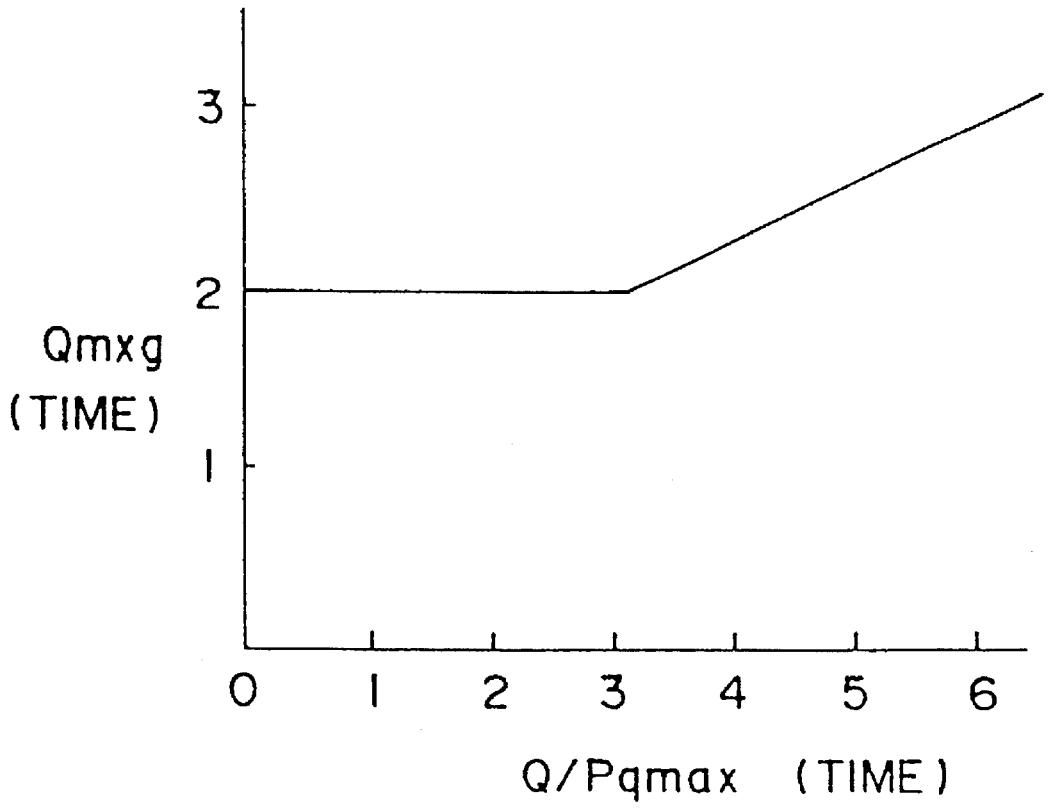
FIG. 27 is a graph showing contents of a table of a gain Qmxg according to this invention.

The gain Qmxg is found by looking up a table summarized in FIG. 27 from the ratio (Q/Pqmax) of the air flowrate Q obtained from the air flow meter 4 to the predicted value Pqmax (step 114). In FIG. 27, the value of the gain Qmxg is constant in the region where Q/Pqmax is small, but the value of the gain Qmxg is made large in the region where Q/Pqmax is large.

For example, in the region where the throttle valve opening Tvo is small and the control valve 22 is fixed in the fully open position, the air-fuel ratio shifts too far towards lean so that misfire occurs and engine speed falls too low, however by setting the characteristics of the gain Qmxg in this way, lean misfire is prevented. As Q/Pqmax represents the extent to which the control valve 22 operates incorrectly, the upper limit Fqmax is set high compared to the predicted value Pqmax so that misfire does not occur when there is a high probability of incorrect operation of the control valve.

(3-2) Basic injection pulse width Tp corresponding to cylinder intake air volume In FIG. 4, a basic injection pulse width Tp corresponding to cylinder intake air volume is calculated from the upper limit Fqmax(=Q) when Q>Fqmax, otherwise Tp is found using Q as it is. This calculation is performed by means of the following Equations [12],[13] (step 25).

Equation [12]:

$$TpO=(Q/Ne)*KCONST\#*Ktrm$$

Equation [13]:

$$Tp=TpO*Fload+Tp*(1-Fload)$$

where,

TpO=basic injection pulse width corresponding to throttle opening

KCONST#=constant giving basic air-fuel ratio

Ktrm=trimming coefficient

Fload=intake pipe delay coefficient

Equation [13] allows for the response delay of air in the intake pipe during transient operation. The meaning of transient operation in this context relates to change of engine running conditions, and has no relation to change-over of air-fuel ratio.

(3-3) Fuel injection pulse width Ti

Figure 2:
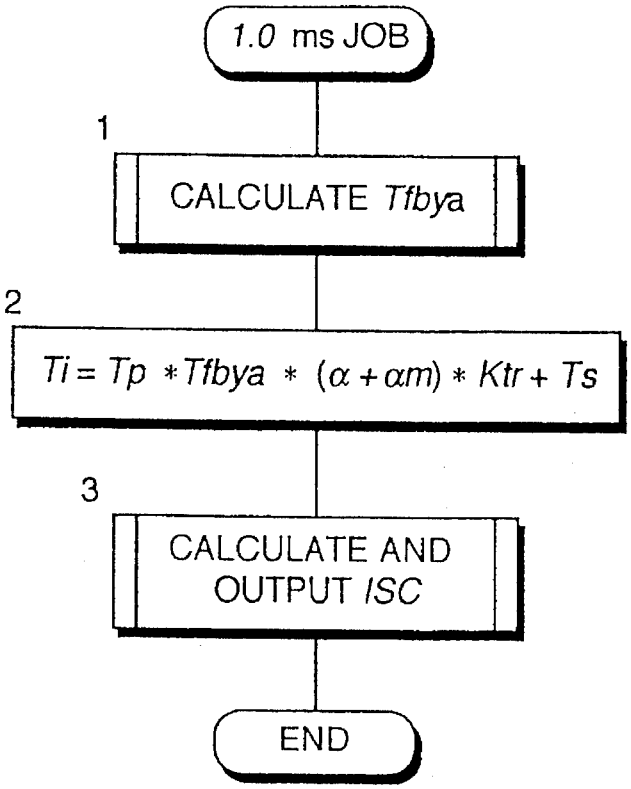
FIG. 2 is a flowchart showing a process of computing a fuel injection pulse width Ti according to this invention.

A fuel injection pulse width Ti supplied to the injector 3 in an intake port **12*b* is computed according to the flowchart of FIG. 2**. This is calculated by means of the following Equation [14].

Equation [14]:

$$Ti=Tp*Tfbya*(\alpha+\alpha m)*Ktr+Ts$$

where,

α=feedback correction coefficient of air-fuel ratio

αm=air-fuel ratio learning control coefficient

Ktr=transient correction coefficient

Ts=ineffectual pulse width depending on battery voltage

Figure 3:
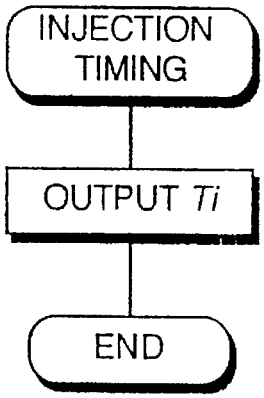
FIG. 3 is a flowchart showing a process of outputting the fuel injection pulse width Ti.

The calculation results are output to correspond to the injection timing as shown in FIG. 3 (step 11).

The transient correction coefficient Ktr in Equation [14] is a correction for fuel transport delay in the intake pipe. For example, its initial value is determined according to |ΔTvo| when the absolute value |ΔTvo| of the throttle opening variation exceeds a predetermined value (I.e. when it is determined that the vehicle is accelerating or decelerating), and its value decreases with time.

Figure 28:
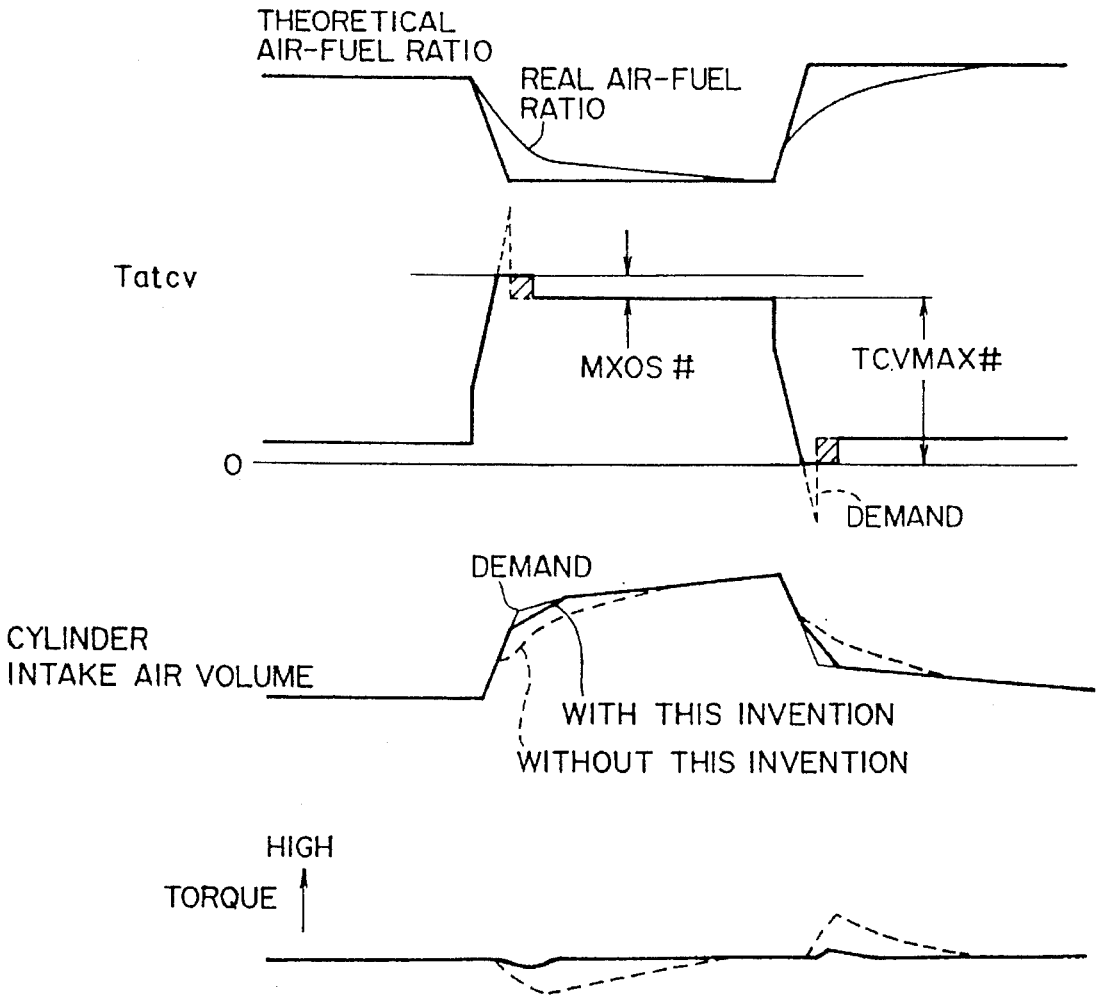
FIG. 28 is a diagram showing an action of the air-fuel ratio controller.

The action of this embodiment will now be described with reference to FIG. 28. The left-hand part of this figure is a waveform corresponding to the case where there is a change-over from the theoretical air-fuel ratio to a lean air-fuel ratio; the right-hand part corresponds to the case when there is a change-over of air-fuel ratio in the reverse direction.

When there is a change-over to a lean air-fuel ratio, the target flowpath cross-sectional area Tatcv computed by Equation [6] rapidly increases, and after it has overflowed the maximum value (TCVMAX#+MXOS#), it decreases to TCVMAX#(flowpath cross-sectional area when there is maximum flowrate through the control valve 22) as shown by the dotted line.

In this case, if the overflow of Tatcv is discarded, the air flowrate required by the cylinder will be insufficient by an amount corresponding to the cross-sectional area of the overflow, and the torque will decrease as shown by the dotted line immediately after change-over of the air-fuel ratio.

In this engine, however, the overflow is stored in the memory and added when computing Tatcv on a subsequent occasion, so the cross-sectional area of the overflow is moved to the shaded region of the figure. In other words, the air mount corresponding to the cross-sectional area of the overflow is supplied at a later time so that the total air demand is met.

The cylinder air flowrate is therefore made to approximate actual requirements, and a torque variation when there is a change-over of air-fuel ratio does not substantially occur as shown by the solid line in the figure. Further, if the maximum value of the target flowpath cross-sectional area Tatcv were set to TCVMAX#, under the conditions shown in FIG. 28, Tatcv would be limited to TCVMAX# after overflow, this overflow would accumulate without being used, and would subsequently be blown out when Tatcv had fallen below TCVMAX#. In other words, the air would be blown out during running conditions far removed from the conditions under which the overflow occurred. This would either lead to an insufficiency of cylinder air flowrate when there was a change-over of air-fuel ratio, or the precision of the air-fuel ratio would fall during running conditions when this air was blown out.

In this invention, however, the maximum value of the target flowrate cross-sectional area Tatcv is a value obtained by adding an offset amount MXOS# to TCVMAX#, and the amount stored in Aokuri is blown out immediately after overflow of Tatcv has ended. The above problem therefore does not occur, and there is no risk that a torque variation will occur when there is a change-over of air-fuel ratio.

On the other hand, if Tatcv becomes a negative value when there is a change-over from a lean air-fuel ratio to the theoretical air-fuel ratio, this negative value is stored, and added (actually subtracted as it is a negative value) on a subsequent occasion. In this case also, therefore, increase and decrease of air flowrate accompanying change-over of air-fuel ratio take place without leading to any excess or deficiency, and torque characteristics remain fiat when the change-over occurs.

A second embodiment of this invention will now be described with reference to FIG. 29–FIG. 35. According to this embodiment, the invention is applied to the processing of the air flowrate signal from an air flow meter installed in the intake passage of an engine. The processed air flowrate signal is then used for controlling the amount of fuel injected into the engine.

Figure 29:
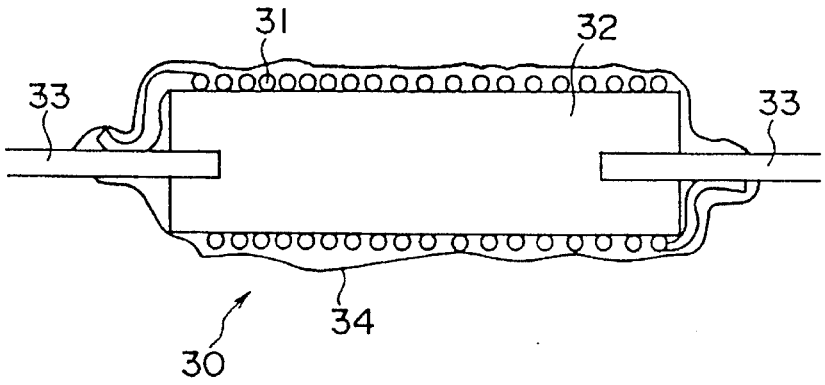
FIG. 29 is an enlarged cross-sectional view of a sensor part of an air flow meter according to a second embodiment of this invention.

FIG. 29 shows a sensor 30 of an air flow meter. The sensor 30 comprises a hot wire 31 which emits heat according to the magnitude of an electric current passing through the wire, this wire 31 being coil wound on a ceramic bobbin 32 and the bobbin being coated with a glass coating 34. The two ends of the hot wire 31 are respectively connected to electrodes 33. A bridge circuit is provided between the electrodes 33 and a control circuit, not shown. The hot wire 31 is cooled the higher the air flowrate surrounding the sensor, hence if the current supplied to the hot wire 31 is increased so as to maintain its temperature constant, the value of the supply current increases in proportion to the air flowrate. This value is converted to an electric voltage, and output as an air flowrate signal.

Figure 30:
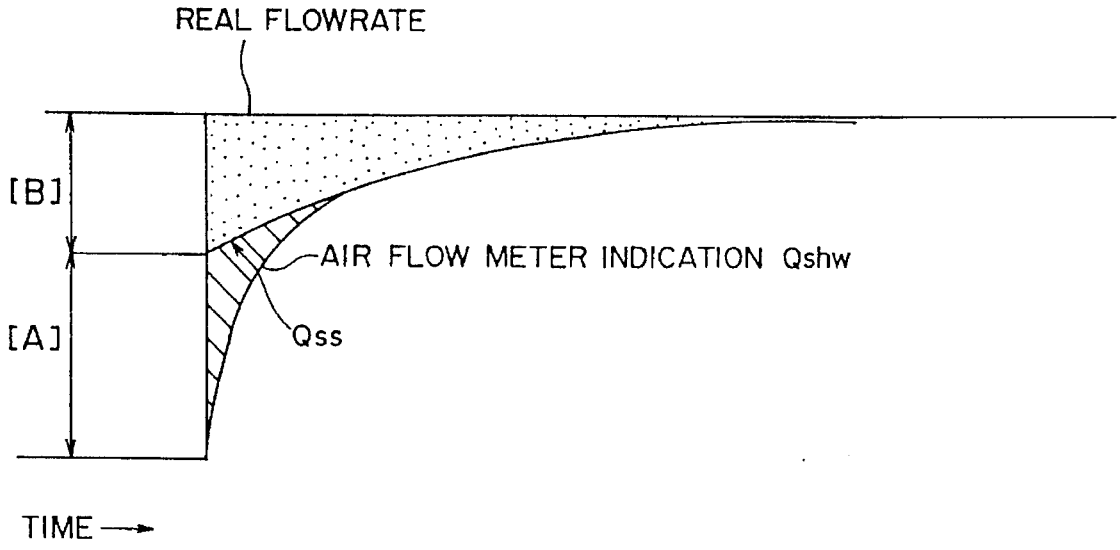
FIG. 30 is a diagram describing a combination of two types of first order delay of the air flow meter.

When the air flowrate changes in a stepwise manner, a response delay occurs between the flowrate variation and the signal output from the air flow meter, shown in FIG. 30. This response delay consists of two parts, viz. [A] a delay corresponding to the general response delay of the sensor, and [B] a delay due to local temperature differences on the hot wire 31. The former delay converges more rapidly than the latter.

The delay [B] arises due to the following reason. The surface of the hot wire 31 wound on the bobbin 32 has some parts which are in contact with the air flow, and some parts which are not in contact with the air flow as they are in contact with the ceramic material of the bobbin. As the heat capacity of ceramic materials is relative large, the temperature of the wire 31 does not immediately change even if the air flowrate changes, so the temperature of the wire 31 varies with a certain time lag. The rate at which heat escapes from various parts of the wire 31 is therefore different which is responsible for the delay [B] mentioned hereinabove.

The processing of the air flow meter output signal and the control of fuel injection amount based on this signal by the aforementioned control circuit, will next be described with reference to the flowcharts of FIG. 31A and 31B.

(4) Signal processing of air flow meter output (4-1) Pre-processing

Figure 31A:
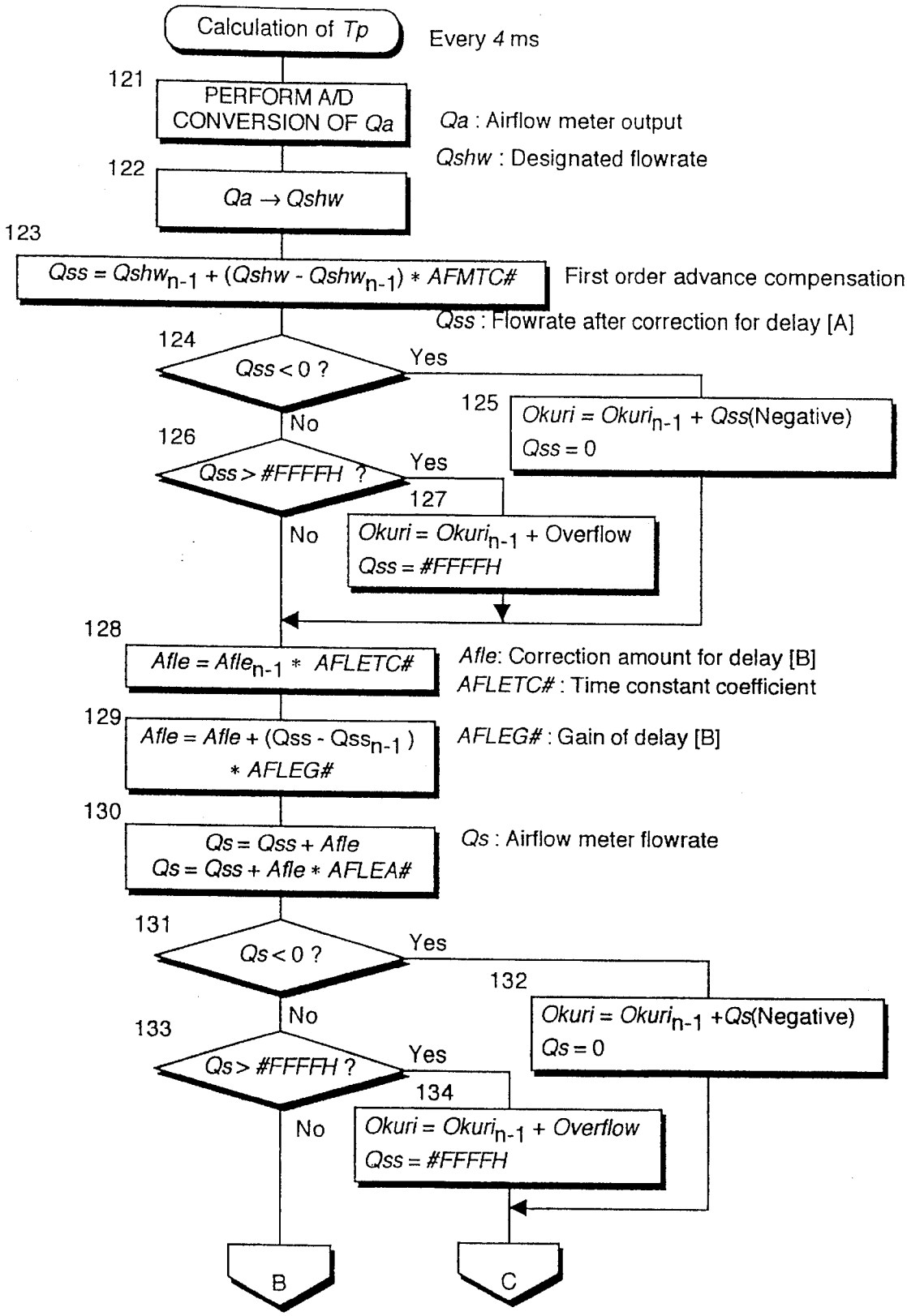
FIG. 31A and 31B are flowcharts describing a process of computing a basic injection pulse width Tp according to the second embodiment.
Figure 32:
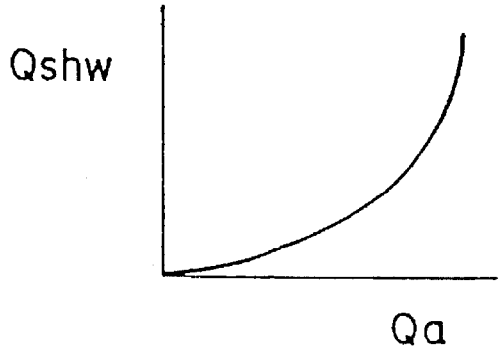
FIG. 32 is a graph showing contents of a table of a designated flowrate Qshw according to the second embodiment.
Figure 33:
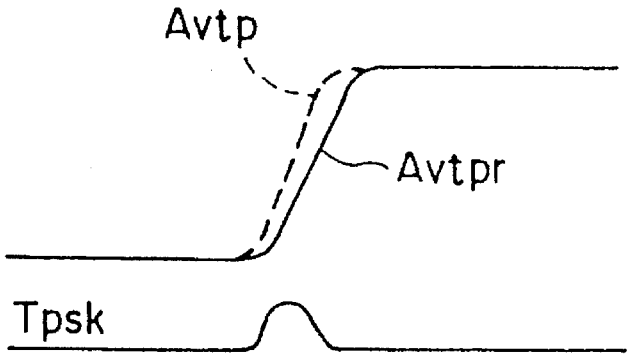
FIG. 33 is a diagram describing a preliminary correction amount Tpsk according to the second embodiment.

The air flow meter output Q, which is a voltage, is linearized using a table summarized in FIG. 32 (step 122 in FIG. 31A). This linearized flowrate is an air flow meter indication flowrate Qshw.

(4-2) Air flow meter flowrate Qs

If the flowrate after the correction for the delay [A] in FIG. 30 is Qss, and the correction amount for the delay [B] in FIG. 30 is Afle, the air flow meter flowrate Qs may be calculated by the following Equations [31] and [32] (step 130).

Equation [31]:

When Afle is positive (during acceleration)

$$Qs=Qss+Afle*AFLEA\#$$

Equation [32]:

When Afle is negative (during deceleration)

$$Qs=Qss+Afle$$

where,

AFLEA#=correction rate during acceleration

The correction rate AFLEA# during acceleration is a value used for correcting the difference between the output response during acceleration and during deceleration and for example may be 1.30.

The corrected flowrate Qss is found by means of the following equation [33] where a first order compensation is added to the flowrate Qshw indicated by the air flow meter (step 123).

Equation [33]:

$$Qss=Qshw_{n-1}+(Qshw-Qshw_{n-1})*AFMTC\#$$

where, $Qshw_{n-1}$=Qshw on immediately preceding occasion

AFMTC#=time constant coefficient related to delay [A]

The correction amount Afle of the delay [B] is found from an Equation [34] by continuously integrating the variation of the corrected flowrate Qss at a predetermine time interval (4 msec), and damping the value of the integral at a predetermined rate.

Equation [34]:

$$Afle=\{Afle_{n-1}+(Q_{ss-Qssn-1})*B/A\}*AFLETC\#$$

where, $Afle_{n-1}$=Afle on immediately preceding occasion $Qssn_{n-1}$=Qss oil immediately preceding occasion B/A=constant AFLETC#=time constant coefficient related to delay [B] (e.g. 0.99)

Equation [34] is modified to obtain Equation [35].

Equation [35]:

$$Afle=Afle_{n-1}*AFLETC\#+(Qss-Qss_{n-1})),*AFLEG\#$$

where,

AFLEG#=gain of delay [B] (e.g. 0.3).

Afle may be determined by means of the following two Equations [36] and [37] (steps 128, 129).

Equation [37]:

$$Afle=Afle_{n-1}*AFLETC\#$$

Equation [38]:

$$Afle=Afle+(Qss-Qss_{n-1})*AFLEG\#$$

Using the air flow meter flowrate found as described hereinabove, the intake flowrate can be measured with a high response precision even during transient condition by a hot wire air flow meter having a sensor provided with a hot wire coiled on a ceramic bobbin, or a film type heating element on the surface of a ceramic bobbin.

However, if the air flow meter flowrate Qs obtained by the aforesaid Equation [31] or Equation [32] is less than the minimum value of the measurement range, i.e. 0, Qs is set equal to 0 (steps 131, 132). Likewise, if Qs exceeds the maximum value #FFFFH of the measurement range, Qs is set equal to #FFFFH (steps 133, 134).

The figures discarded by the above processing are respectively stored in Okuri, and added to Qs when no further discarding takes place.

(i) When Qs<0 or Qs>#FFFFH, the postponed part Okuri is updated by Equation [44] when Qs<0, and by Equation [45] when Qs>#FFFFH (steps 132, 134).

Equation [44]:

$$Okuri=Okuri_{n-1}+Qs$$

where, $Okuri_{n-1}$ is value of Okurl on immediately preceding occasion.

Equation [45]:

$$Okuri=Okuri_{n-1}+(Qs-\#FFFFH)$$

Figure 31B:
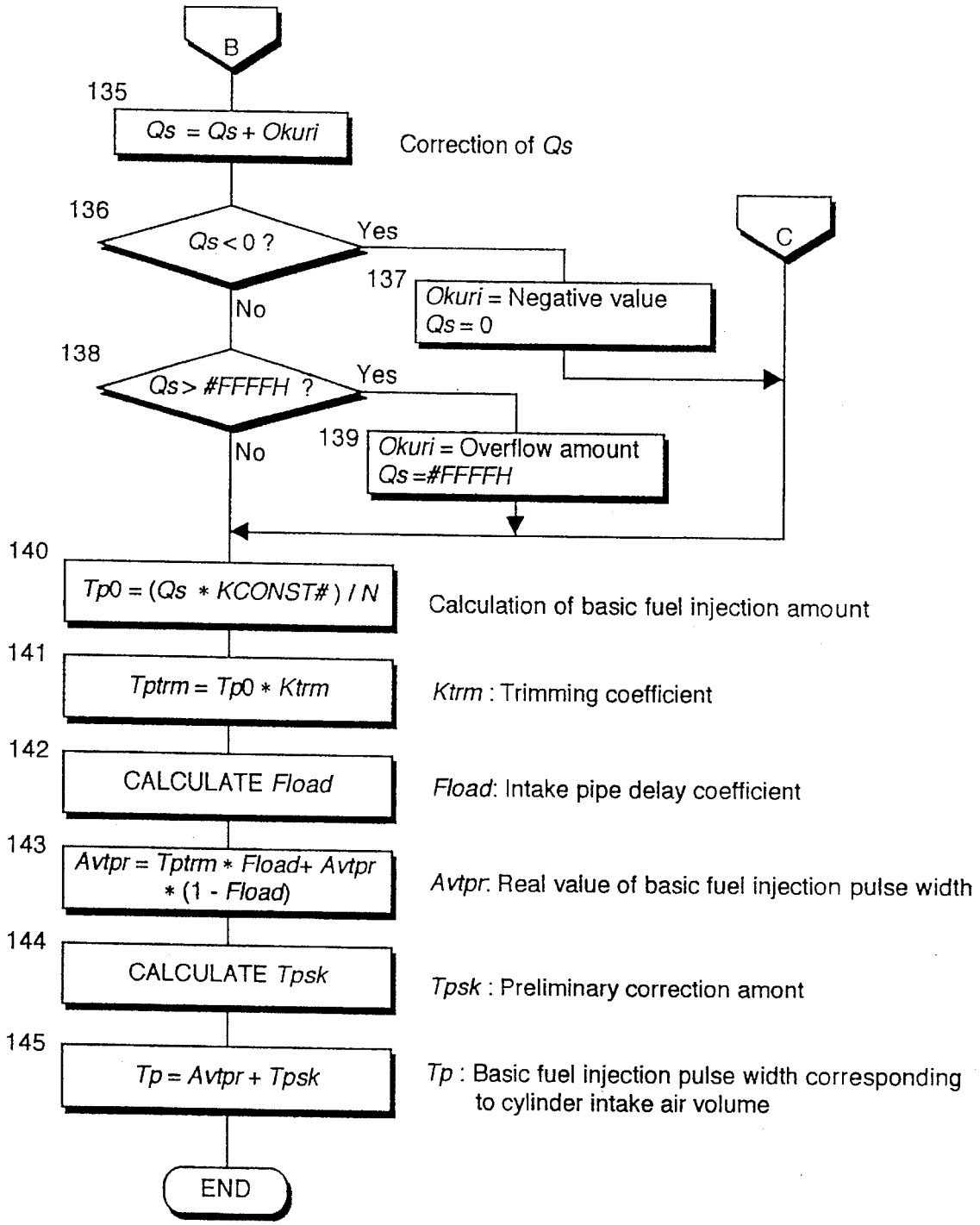

(ii) When neither Qs<0 nor Qs>#FFFFH are true, Qs is updated by means of an Equation [46] (steps 131, 133 and step 135 in FIG. 31B).

Equation [46]:

$$Qs=Qs+Okuri$$

However, if the updated result Qs of Equation [46]<0, Qs is entered in the postponed part Okuri (steps 136, 137), while if Qs>#FFFFH, the quantity (Qss−#FFFFH) is entered in Okuri (steps 138, 139).

Insofar as concerns the corrected flowrate Qss, if the calculation result Qss c Equation [33]<0, Qss is set equal to 0, while if Qss>#FFFFH, Qss is set equal to #FFFFH (steps 124, 125, and steps 126, 127 in FIG. 31A). The figures discarded by this processing are respectively stored in Okuri, and added to Qs when no further discarding takes place.

Further, as Qss is calculated as an intermediate value while calculating Qs, discarded fractions of Qss will be reflected in the final flowrate Qs. (i) If Qss<0, Okuri is updated by Equation [47] (steps 124, 125).

Equation [47]:

$$Okuri=Okuri_{n-1}+Qss$$

(11) If Qss>#FFFFH, Okuri is updated by Equation [48] (steps 126, 127).

Equation [48]:

$$Okuri=Okuri_{n-1}+(Qss-\#FFFFH)$$

(5) Processing of fuel injection amount (5-1) Basic fuel injection pulse width Tp corresponding to cylinder intake air This is calculated by means of Equations [38], [39], [40].

Equation [38]:

$$TpO=(Qs/Ne)*KCONST\#$$

Equation [39]:

$$Tptrm=TpO*Ktrm$$

Equation [40]:

$$Avtpr=Tptrm*Fload+Avtpr_{n-1}*(1-Fload)$$

where, $Avtpr_{n-1}$=immediately preceding value of Avtpr

The value of Avtpr as thus determined is the real value of the basic injection pulse width corresponding to the cylinder air volume (steps 140, 141, 142, 143). The basic injection pulse width Tp corresponding to the cylinder intake air volume will now be found (step 145):

Equation [41]:

$$Tp=Avtpr+Tpsk$$

where,

Tpsk=preliminary correction coefficient

Equations [38], [39], [40], [41] correspond to Equations [12], [13] of the aforesaid first embodiment. The only difference from the first embodiment is the introduction of the preliminary correction coefficient Tpsk. Ne, KCONST#, Ktrm, Fload therefore have the same significance as in the first embodiment.

The preliminary correction coefficient Tpsk of Equation [41] is found by means of Equation [42] from the variation of Avtpr.

Equation [42]:

$$Tpsk=(Avtpr-Avtpr_{n-1})*GADVTP\#$$

where,

GADVTP# is a preliminary correction gain.

Tpsk is a correction for dead time, i.e. the response delay of the injection value and the sonic delay between the air flow meter and air intake throttle. Due to this dead time, the air-fuel ratio during acceleration tends to lean. The fuel injection amount is therefore increased by Tpsk so that the air-fuel ratio does not tend to lean in the initial stage of acceleration even though there may be some dead time.

(5-2) Fuel injection pulse width Ti

When the hot wire air flow meter having the sensor of FIG. 29 is used in the lean burn engine of the first embodiment, a fuel injection pulse width Ti is calculated by means of Equation [14] as in the first embodiment.

When it is used not in a lean burn engine but in an ordinary engine equipped with a three-way catalytic converter, the fuel injection pulse width Ti may be calculated by means of the same equation. In this case, the target air-fuel ratio Tfbya is a value obtained by putting Kmr=1 in Equation [8].

Figure 34:
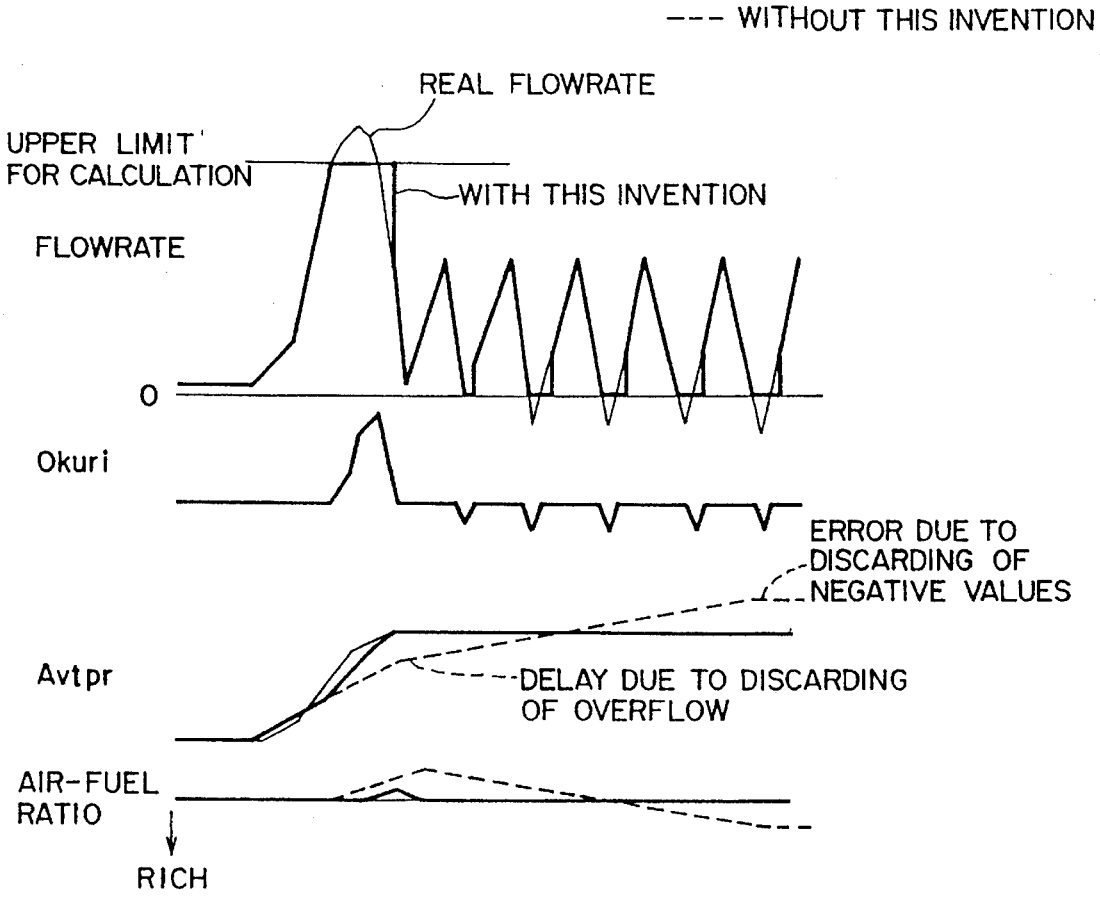
FIG. 34 is a diagram describing am air-fuel ratio control during rapid acceleration according to the second embodiment.

FIG. 34 is a waveform obtained when there is a very strong intake air pulsation due to the fact that the throttle is fully open. This may for example occur in an engine of less than six cylinders when it is rapidly accelerated. In this case, Qs as calculated by Equation [31] may be negative, or it may overflow beyond the maximun value #FFFFH. In the signal processing of this embodiment, unlike that of the first embodiment, signals which follow discarding of negative values or overflows are integrated by means of Equation [40]. The basic injection pulse width Avtpr corresponding to the cylinder intake air volume which is the output after integration therefore tends to lean as shown by the dotted line in FIG. 34 due to discarding of the overflow, or tends to a richer value than is required due to discarding of negative values. A delay thus occurs in Avip due to discarding of overflow, or Avtpr increases unnecessarily due to the discarding of negative values. On the other hand, by adding discarded negative values and overflows when there are no further negative values or overflows, there is no loss of calculation precision of Avtpr and the characteristics of the air-fuel ratio remain flat.

Figure 35:
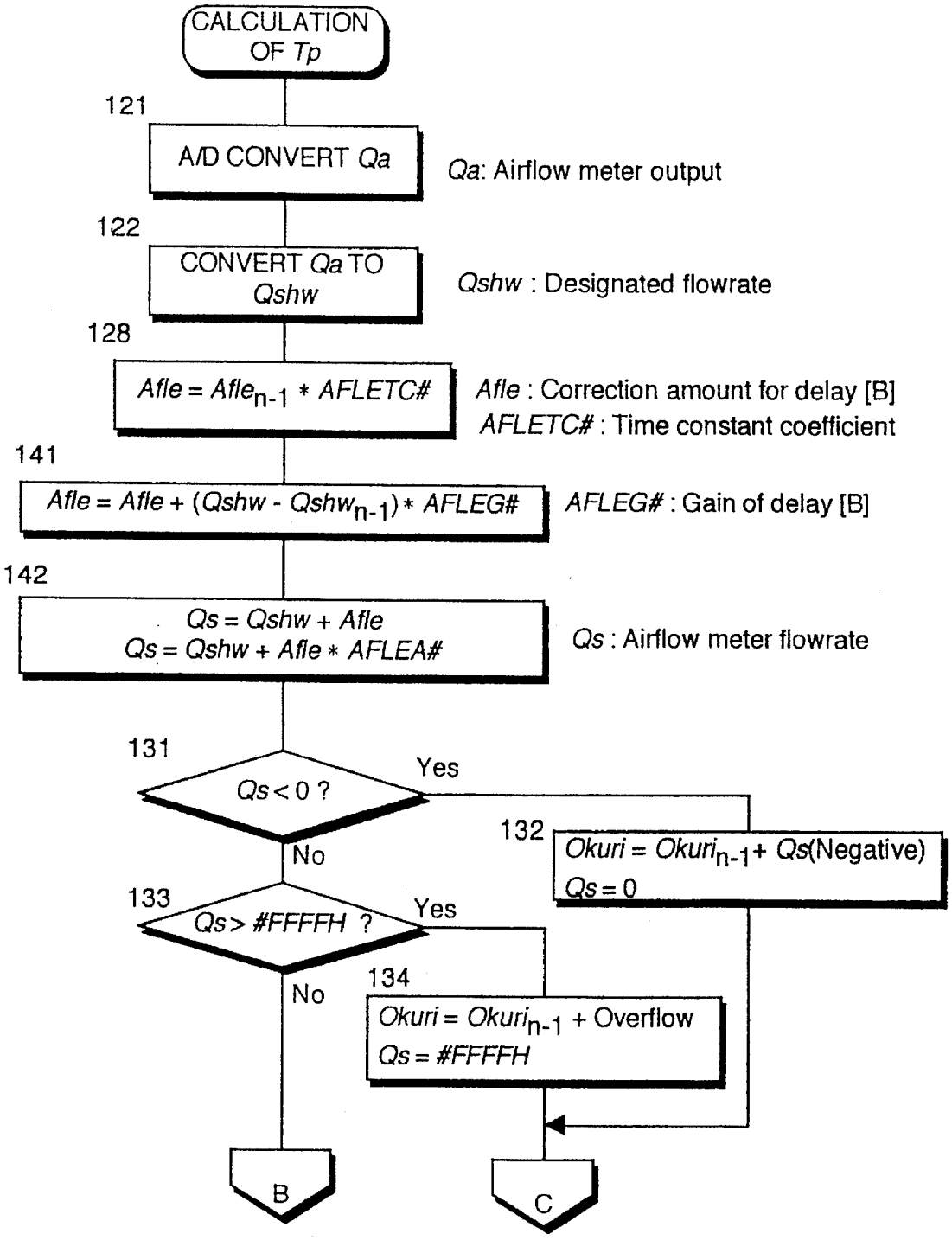
FIG. 35 is a flowchart showing a possible substitute for the process of FIG. 31A.

If the delay [A] is extremely small so that it can be ignored, it is possible to skip applying a correction to the delay [A] as shown by the flowchart in FIG. 35.

Further, it has been assumed herein that the target flowpath cross-sectional area Tatcv in the first embodiment, and the air flow meter flowrate Qs in the second embodiment may both be less than their preset minimum values or greater than their preset maximum values. However, this invention may likewise be applied when these signal values are never greater than the maximum values or never smaller than the minimum values.

Moreover, even in the case of the signals described in this embodiment, the system may be arranged so that the signals are never greater than the maximum computed values or never smaller than the minimum computed values. For example, if the maximum computed value is retained and the zero point which is the minimum computed value is offset by a negative amount, negative values for the computed result of the intake air volume will be avoided.

The embodiments of this invention in which an exclusive property or privilege claimed are defined as follows:

1. A system for controlling a property of a device, comprising:

a sensor which produces a signal indicative of a working condition of said device; and a microprocessor programmed to (a) receive said signal, (b) perform a predetermined calculation on said signal to acquire a calculated value, (c) compare the calculated value with a predetermined value, (d) set a control value by one of the following:

(1) setting said predetermined value as said control value if said calculated value is greater than said predetermined value, while storing a surplus value indicative of an excess of said calculated value above said predetermined value, and (2) setting said calculated value as said control value if said calculated value is less than said predetermined value, said control value being increased to a larger value than said calculated value if there exists a previously stored surplus value, and (e) supply a control signal to vary a property of said device according to said control value.

2. A system as recited in claim 1, wherein said microprocessor compares said calculated value with an upper and a lower predetermined value and determines if said calculated value lies between said upper and said lower predetermined value.

3. A system as recited in claim 1, wherein said microprocessor is further programmed to determine whether said control value is increased to a value larger than said predetermined value, calculate an excess amount of said control value above said predetermined value, modify said control value to said predetermined value, and replace said surplus value with said excess amount.

4. A fuel injection system for an engine having an intake air passage having a throttle and a supplementary air passage bypassing said throttle, a target air-fuel ratio for said fuel injection system being changed according to running conditions of said engine, said system comprising:

a flowrate control valve provided in said supplementary air passage;

a sensor which detects an amount of said intake air;

a fuel injection valve for injecting fuel towards air drawn into said engine from said intake air passage in accordance with an amount of said fuel injection which is based on said intake air amount and said target air-fuel ratio; and a microprocessor programmed to (a) perform a predetermined calculation on said target air-fuel ratio to acquire a calculated value, (b) compare the calculated value with a predetermined value, (c) set a target flowpath cross-sectional area of said flowrate control valve by one of the following:

(1) setting said predetermined value as said target flowpath cross-sectional area if said calculated value is greater than said predetermined value, while storing a surplus value indicative of an excess of said calculated value above said predetermined value, and (2) setting said calculated value as said target flowpath cross-sectional area if said calculated value is less than said predetermined value, said target flowpath cross-sectional area being increased to a larger value than said calculated value if there exists a previously stored surplus value, and (d) supply a control signal to vary an opening of said flowrate control valve according to said target flowpath cross-sectional area.

5. A system as recited in claim 4, wherein said microprocessor compares said calculated value with an upper and a lower predetermined value and determines if said calculated value lies between said upper and said lower predetermined value.

6. A system as recited in claim 4, wherein said microprocessor is further programmed to determine whether said target flowpath cross-sectional area is increased to a value larger than said predetermined value, calculate an excess amount of said target flowpath cross-sectional area above said predetermined value, modify said target flowpath cross-sectional area to said predetermined value, and replace said surplus value with said excess amount.

7. A system for controlling an amount of fuel injected into an engine, comprising:

an air flow meter having a heating element wound on a ceramic bobbin and a circuit for supplying electrical current to said heating element, said heating element being exposed to an air flow through said air flow meter, said electrical current being controlled for maintaining a temperature of said heating element constant and being measured for detecting an air flowrate, said circuit outputting said electrical current as a signal; and a microprocessor programmed to (a) receive said signal, (b) perform a predetermined calculation on said signal to acquire a calculated value, (c) compare the calculated value with a predetermined value, (d) set a control value by one of the following:

(1) setting said predetermined value as said control value if said calculated value is greater than said predetermined value, while storing a surplus value indicative of an excess of said calculated value above said predetermined value, and (2) setting said calculated value as said control value if said calculated value is less than said predetermined value, said control value being increased to a larger value than said calculated value if there exists a previously stored surplus value, and (e) supply a control signal to vary said amount of fuel injected according to said control value.

8. A system as recited in claim 7, wherein said microprocessor compares said calculated value with an upper and a lower predetermined value and determines if said calculated value lies between said upper and said lower predetermined value.

9. A system as recited in claim 7, wherein said microprocessor is further programmed to determine whether said control value is increased to a value larger than said predetermined value, calculate an excess amount of said control value above said predetermined value, modify said control value to said predetermined value, and replace said surplus value with said excess amount.

* * * * *